US011210892B2

(12) United States Patent
Snow

(10) Patent No.: US 11,210,892 B2
(45) Date of Patent: Dec. 28, 2021

(54) SYSTEMS AND METHODS FOR ADMINISTERING SHARED OUTCOME GAMES WITH PROGRESSIVE SIDE FEATURES

(71) Applicant: SG Gaming, Inc., Las Vegas, NV (US)

(72) Inventor: Roger M. Snow, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 39 days.

(21) Appl. No.: 16/877,688

(22) Filed: May 19, 2020

(65) Prior Publication Data

US 2020/0388101 A1 Dec. 10, 2020

Related U.S. Application Data

(60) Provisional application No. 62/851,757, filed on May 23, 2019.

(51) Int. Cl.

| | |
|---|---|
| ***A63F 1/00*** | (2006.01) |
| ***G07F 17/32*** | (2006.01) |
| ***A63F 1/14*** | (2006.01) |
| ***A63F 1/06*** | (2006.01) |

(52) U.S. Cl.

CPC ..... *G07F 17/322* (2013.01); *A63F 1/067* (2013.01); *A63F 1/14* (2013.01); *G07F 17/3211* (2013.01); *G07F 17/3258* (2013.01); *G07F 17/3262* (2013.01); *G07F 17/3293* (2013.01); *A63F 2001/001* (2013.01); *A63F 2001/008* (2013.01)

(58) Field of Classification Search

CPC ..... A63F 2001/001

See application file for complete search history.

(56) References Cited

U.S. PATENT DOCUMENTS

| | | | | |
|---|---|---|---|---|
| 6,293,864 | B1 * | 9/2001 | Romero | A63F 3/00157 273/274 |
| 9,827,484 | B2 | 11/2017 | Shigeta | |
| 2002/0010014 | A1 * | 1/2002 | Parra | G07F 17/3211 463/17 |
| 2005/0116417 | A1 * | 6/2005 | Soltys | A63F 3/00157 273/292 |
| 2013/0001876 | A1 | 1/2013 | Chen | |
| 2017/0203199 | A1 | 7/2017 | Abrahamson | |
| 2018/0015358 | A1 | 1/2018 | Mahon | |

FOREIGN PATENT DOCUMENTS

| | | | |
|---|---|---|---|
| AU | 2014252106 | B2 | 11/2017 |
| WO | 2014167781 | A1 | 10/2014 |

* cited by examiner

*Primary Examiner* — Seng H Lim

(57) ABSTRACT

A system including a gaming table with multiple player positions, a shoe containing a shuffled set of cards, a layout positioned on the gaming table and marked with indicia to indicate the player positions, and a game controller. A card sensor of the shoe generates rank data indicating an identified rank of each card drawn from the shoe. Each player position is marked with a unique identifier matching a rank of a subset of the cards. The game controller receives the rank data for a set of four drawn cards from the shoe and, in response to determining that at least two of the four drawn cards have a rank that is equal to the unique identifier of one player position and that a secondary wager has been registered for that unique identifier, provides a visual indication of a payout to a player at the player position.

20 Claims, 9 Drawing Sheets

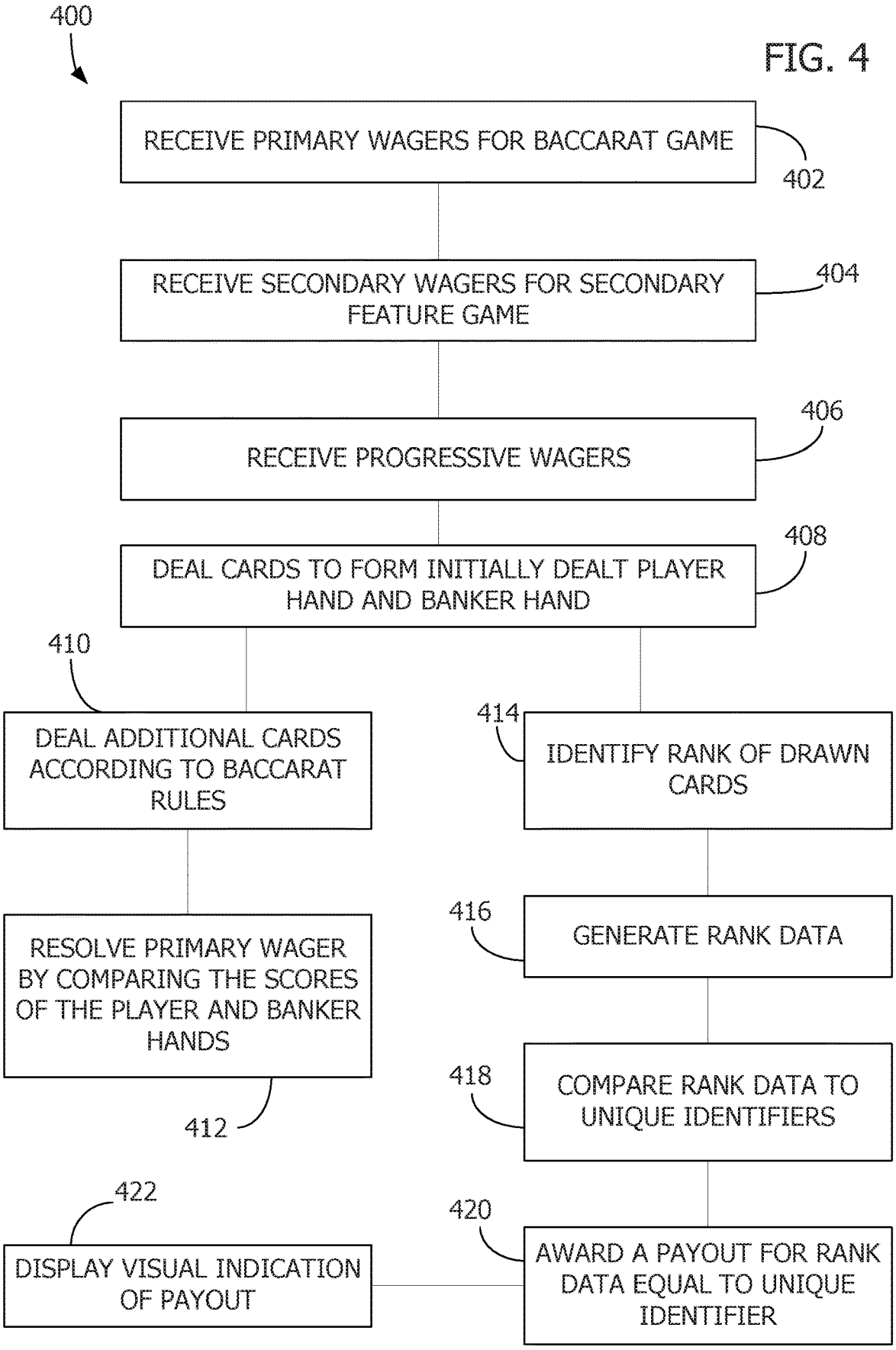
400
FIG. 4
RECEIVE PRIMARY WAGERS FOR BACCARAT GAME
402
RECEIVE SECONDARY WAGERS FOR SECONDARY FEATURE GAME
404
RECEIVE PROGRESSIVE WAGERS
406
DEAL CARDS TO FORM INITIALLY DEALT PLAYER HAND AND BANKER HAND
408
410
DEAL ADDITIONAL CARDS ACCORDING TO BACCARAT RULES
414
IDENTIFY RANK OF DRAWN CARDS
RESOLVE PRIMARY WAGER BY COMPARING THE SCORES OF THE PLAYER AND BANKER HANDS
416
GENERATE RANK DATA
412
418
COMPARE RANK DATA TO UNIQUE IDENTIFIERS
422
420
DISPLAY VISUAL INDICATION OF PAYOUT
AWARD A PAYOUT FOR RANK DATA EQUAL TO UNIQUE IDENTIFIER

SYSTEMS AND METHODS FOR ADMINISTERING SHARED OUTCOME GAMES WITH PROGRESSIVE SIDE FEATURES

CROSS-REFERENCE TO RELATED APPLICATIONS

This application claims the benefit of priority to U.S. Provisional Application No. 62/851,757, filed May 23, 2019, the contents of which are hereby incorporated by reference in their entirety.

FIELD

This disclosure relates generally to methods of administering wagering games for casinos and other gaming establishments, and related systems and apparatuses. More specifically, disclosed embodiments relate to methods of administering games of baccarat including side wagers.

BACKGROUND

Baccarat is a wagering game played in casinos and other gaming establishments. Some players may be hesitant to play baccarat, because they believe it to be a relatively simple game with little excitement and no potential for a large payout unless a correspondingly large wager is placed.

Some attempts have been made to increase the profitability of baccarat and increasing the perceived excitement of the game. For example, U.S. Pat. No. 6,789,801, filed Dec. 4, 2002 and issued Sep. 4, 2004, for "BACCARAT SIDE WAGER GAME," the disclosure of which is incorporated herein in its entirety by this reference, discloses a baccarat derivative or mini-baccarat derivative, wherein there is at least one potential payout on the side bet bonus wager in addition to normal play of the game. One payoff for wagering on a winning hand in the side bet bonus wager (either the player hand or a banker hand) is based upon the hand that is wagered upon having a natural (two-card) 8-count or 9-count. A second potential payout on the side bet bonus wager is based upon the size of the difference between the player hand point count and the dealer hand point count.

One challenge of modifying the features of baccarat is that the outcome of the game is shared by all of the players. That is, each and every player can win any given hand or round of play. Baccarat and other games with this feature may be referred to as "shared outcome games." Modifying the base game of baccarat in a manner that is exciting and beneficial to the player may create an imbalance between payouts and funding of the game. Accordingly, secondary or side game features may be desired to provide additional opportunities to engage the players while adding an additional method of funding such features without substantive modification to the base game play.

BRIEF SUMMARY

In some embodiments, a system including a gaming table with multiple player positions, a shoe containing a shuffled set of cards, a layout positioned on the gaming table and marked with indicia to indicate the player positions, and a game controller. A card sensor of the shoe generates rank data indicating an identified rank of each card drawn from the shoe. Each player position is marked with a unique identifier matching a rank of a subset of the cards. The game controller receives the rank data for a set of four drawn cards from the shoe and, in response to determining that at least two of the four drawn cards have a rank that is equal to the unique identifier of one player position and that a secondary wager has been registered for that unique identifier, provides a visual indication of a payout to a player at the player position.

In other embodiments, a method of administering a baccarat secondary bet using a system including (i) a gaming table with multiple player positions, (ii) a shoe containing a shuffled set of cards, (iii) a layout positioned on an upper surface of the gaming table and marked with indicia to indicate the multiple player positions, each player position marked with a unique identifier matching a rank of at least one subset of cards in the set of cards, and (iv) a game controller communicatively coupled to the shoe is provided. The method includes (a) dispensing, by a delivery end of the shoe, cards manually drawn from the set of cards; (b) identifying, by at least one card sensor, a rank of each drawn card; (c) generating, by the at least one card sensor, rank data indicating the identified rank of each drawn card; (d) receiving, by the game controller, the rank data for a set of four cards drawn in a game of baccarat from the shoe; and (e) in response to determining, by the game controller, that at least two of the four drawn cards have an equal rank that is equal to the unique identifier of one of the player positions and that a secondary wager has been registered for that unique identifier, providing a visual indication of a payout to a player at the one of the player positions.

In further embodiments, a game controller for administering a baccarat secondary bet is provided. The game controller is positioned at a gaming table with multiple player positions and a layout positioned on an upper surface of the gaming table. The layout is marked with indicia to indicate the multiple player positions and a unique identifier for each player position. The game controller is communicatively coupled to a shoe containing a shuffled set of cards, wherein each unique identifier matches a rank of at least one subset of cards in the set of cards. The game controller includes a communication device communicatively coupled to at least one card sensor of the shoe that identifies a rank of each drawn card and generate rank data indicating the identified rank of each drawn card, at least one processor, and a memory device that stores computer-executable instructions that, when executed by the at least one processor, cause the game controller to be configured to (i) receive the rank data for a set of four cards drawn in a game of baccarat from the shoe, and (ii) in response to determining that at least two of the four drawn cards have an equal rank that is equal to the unique identifier of one of the player positions and that a secondary wager has been registered for that unique identifier, provide a visual indication of a payout to a player at the one of the player positions.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

FIG. 4 is a flow diagram of an example method of administering a wagering game in accordance with at least one embodiment of this disclosure;

DETAILED DESCRIPTION

Figure 1:
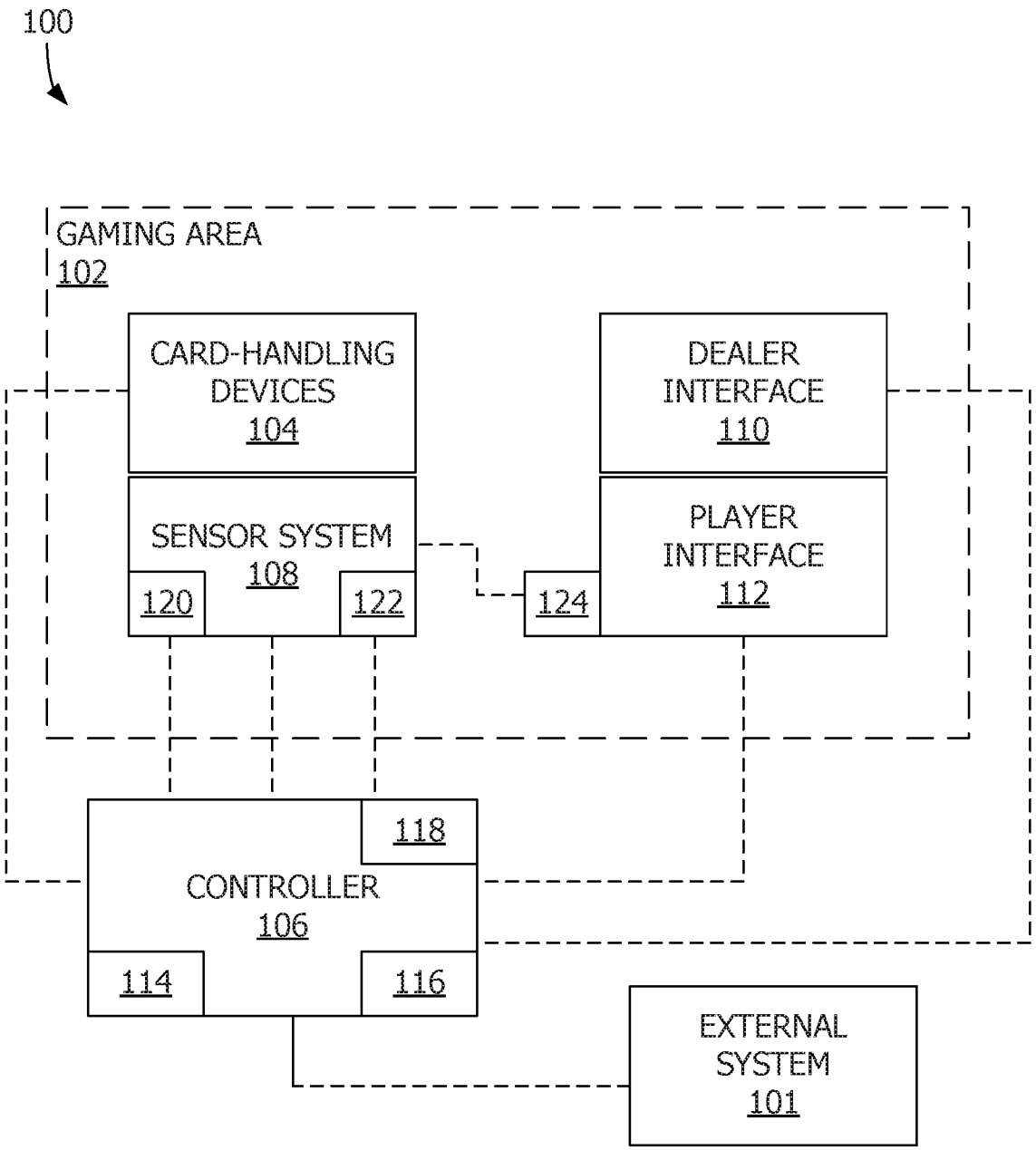
FIG. 1 is a block diagram of an example system for administering a wagering game according to at least one embodiment of this disclosure.

The illustrations presented in this disclosure are not meant to be actual views of any particular act in a method, apparatus, system, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix.

The terms "gaming," "gambling," or the like, refer to activities, games, sessions, rounds, hands, rolls, operations, and other events related to wagering games the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," such as "house-banked" and "player-banked" configurations, each of which is described in more detail below) or in wagering games that involve no real-world monetary risks for the player (e.g., the "play-for-fun" and "social play-for-fun" configurations described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local game, as well as virtual representations of money in the form of electronic authorizations of a transfer of money and digital representations of money (e.g., digital representations of bills or coins, digital representations of chips, numerical quantities of money, numerical quantities of points, or numerical quantities of credits) at a local or remote electronic gaming device. As used herein, the term "wagering element" means and includes objects and symbols used to signify the acceptance of a wager. For example, physical wagering elements include physical money (e.g., bills and coins) and physical wagering tokens (e.g., poker chips), which may or may not be redeemable for monetary value and may or may not include electronic identifiers (e.g., RF ID chips) embedded within the tokens, enabling electronic sensing and tracking of wagering. Virtual wagering elements include, for example, images (e.g., images of money or poker chips) and text (e.g., a string of numbers), which may or may not be redeemable for monetary value. In the "play-for-fun" and "social play-for-fun" configurations, a "wager" may not have a cash value (i.e., a real-world monetary value).

For the purposes of this description, it will be understood that when an action related to accepting wagers, making payouts, dealing cards, selecting cards, or other actions associated with a player or a dealer is described herein, and such description includes a player or a dealer taking the action, the results of the action may be computer generated and may be displayed on a live or virtual table or electronic display, and, if applicable, the reception or detection of such an action in an electronic form where player and dealer choices, selections, or other actions are received at an electronic interface. This further includes the results of a virtual dealer and virtual players, where the actions described are actually generated by a computer (typically associated with an online game). By way of a further example, if dealing of a card is described herein, the description includes (but is not limited to) the following: the dealing of a card by a dealer from a deck, shuffler, shoe, or other card source and the reception or placement of the card at a table location associated with a player or reception directly by a player; the generation and transmission of an electronic indication or representation of a card from a game play source or server to an electronic receiver, where the receiver may be at a table (using virtual cards) including players and/or virtual players and/or a dealer or virtual dealer, on a gaming terminal, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player, or, associated with a virtual player.

Systems and methods are described herein for administering a card game with secondary wagers. More specifically, the systems and methods described herein provide a card-based game with a secondary wager based on unique identifiers associated with player positions at a gaming table and/or other unique identifiers. In one example in which the card-based game is baccarat, players provide secondary wagers to qualify for a secondary game feature that occurs within the base play of baccarat. In such an example, a player is assigned a unique identifier that may be associated with the particular player position at which the player is located (either physically or digitally) relative to a gaming area. The initially dealt cards of the dealer and the respective player (i.e., two cards for the dealer, two cards for each player) during the base game play are evaluated for the secondary game feature at least by comparing the value of each card to the unique identifier of the player. If the card values of at least some of the initially dealt cards have an equal rank that matches or is equal to the unique identifier and the player associated with the unique identifier has placed a secondary wager, an award may be provided to the player in accordance with one or more secondary payout tables.

Although baccarat is the example card game used below, it is to be understood that other games involving unique identifiers assigned to players and that can be matched with one or more game elements may incorporate the features described below. In addition, features and methods described herein may be implemented using any suitable system, including systems including a physical gaming area and/or a digital gaming area (e.g., online games).

FIG. 1 is a block diagram of an example gaming system 100 that may be used to administer a game according to at least some aspects of the present disclosure. The system 100 includes a gaming area 102, one or more card-handling devices 104, a controller 106, a sensor system 108, a dealer interface 110, and one or more player interfaces 112. In other embodiments, the system 100 may include additional, fewer, or alternative components, including those described elsewhere herein.

The gaming area 102 is a physical and/or digital environment in which playing cards or other game elements may be presented to players during play of a game. In one example, the gaming area 102 may be a gaming table including a surface with markings, indicators, and the like for directing game play. In another example, the gaming area 102 may be digitally represented (e.g., for an online game or a game presented on a digital interface) such that the markings, indicators, and the like are graphically represented. The markings and indicators may define within the gaming area 102 different subsections of the gaming area 102 that have one or more specific functions within a game. Examples of such subsections may include, but are not limited to, betting areas, community card areas, device areas (e.g., for locating and/or mounting card-handling devices 104 at the gaming area 102), dealer areas, and/or player areas. In the example embodiment, each player area is associated with a single player and a single player position of the gaming area 102. The gaming area 102 may have a limited number of player positions, such as four, six, or eight player positions. As described in further detail below, each player position may be marked with a unique identifier that can be matched to one or more characteristics of a game element (e.g., each player position has a unique number, and is matched to the numerical value of one or more cards).

The card-handling devices 104 may be configured to facilitate sorting, shuffling, and/or dealing playing cards. The card-handling devices 104 may include, for example, a shoe, an automatic card shuffler, and/or other suitable card-handling devices. In the example embodiment, the card-handling devices 104 include at least a shoe that stores playing cards to be dealt. The shoe may include an area for storing a number of playing cards (e.g., four to eight decks of standard playing cards) and a delivery end at which playing cards are automatically or manually dispensed or dealt from the storage area for play of a game. In certain embodiments, the shoe may include components that enable monitoring of the playing cards, the state of the game, and/or other suitable aspects of a game or the gaming area 102. For example, the shoe may include, but is not limited to, one or more processors, memory, sensors, and the like for monitoring, analyzing, and/or presenting information associated with the system 100.

The controller 106 is one or more computing devices configured to monitor, manage, and/or control the system 100 and the game administered using the system 100. More specifically, the controller 106 includes one or more processors 114, memory 116, and communication devices 118 that operate to monitor, manage, and/or control functions of the system 100 and the corresponding gameplay. The processors 114 are configured to execute computer-readable instructions stored by the memory 114 to perform at least the functions of the controller 106 described herein. The communication devices 118 enable data communication (wired and/or wireless) between the controller 106 and other components or external systems (e.g., a server system configured to provide back-end services). In certain embodiments, the communication devices 118 are distributed among different subsections or devices of the controller 106 to enable data communication between the subsections.

The processors 114, memory 116, and/or the communication devices 118 may be distributed among several devices or localized to a single device in the system 100. For example, the shoe of the card-handling devices 104 may include a portion of the controller 106 or the controller 106 in its entirety. The controller 106 may be a standalone device of the system 100 in certain embodiments. In at least some embodiments, the controller 106 may be communicatively coupled to one or more remote systems 101, such as remote servers that monitor aspects of the system 100 and/or the game administered by the system 100. For example, the remote system 101 may be an accounting server system that tracks wagers and payouts of the game via communication with the controller 106. In other embodiments, the controller 106 may be a distributed computing device such that at least a portion of the controller 106 is remotely located from the gaming area 102 and the rest of the system 100.

The controller 106 is communicatively coupled to at least a portion of the sensor system 108 to collect sensor data. The sensor system 108 includes one or more sensors located within the system 100 and/or around the gaming area 102 to monitor one or more aspects of the system 100 and the administered gameplay. The sensors may include, but are not limited to, image sensors, temperature sensors, pressure sensors, strain sensors, line-of-sight (LOS) sensors, and the like. In the example embodiment, the sensor system 108 includes at least a plurality of bet sensors 120, at least one card sensor 122, and one or more device sensor 124. In other embodiments, additional, fewer, or alternative sensors may be included within the senor system 108, including those described elsewhere herein. In some embodiments, the sensor system 108 may include processors, memory, and the like for analyzing, storing, and/or communicating the collected sensor data. In other embodiments, the controller 106 is configured to perform the computing functionality of the sensor system 108.

The bet sensors 120 are configured to monitor at least a portion of the gaming area 102 for one or more bets or wagers. In the example embodiment, the bet sensors 120 are divided into subsets including one or more of the bet sensors 120. Each subset may be configured to monitor a portion of the gaming area 102 associated with a particular player position such that sensor data from the subset may be associated with the corresponding player position for monitoring and analysis. In other embodiments, at least a portion of the bet sensors 120 may monitor a plurality of player positions for wagers. For example, one or more overhead image sensors or cameras may be used to capture images or video of every player position of the gaming area 102.

In at least some embodiments, the bet sensors 120 may detect the presence of tokens representing wagers and collect sensor data associated with the detected tokens. Any suitable technique or combination of techniques may be used for detection and/or to distinguish between the tokens to facilitate a value determination of the wager. For example, the presence of one or more tokens may be determined via image, pressure, and/or LOS sensor data, and an image of the tokens may be captured for a value determination of the wager.

The card sensor 122 is positioned along a card path (i.e., the path taken by cards through the card-handling devices 104 and to the gaming area 102) to capture one or more characteristics of the cards to facilitate monitoring of the gameplay without exposing the cards to the dealer and/or the players. In the example embodiment, the card sensor 122 is positioned to capture an image of cards being dealt from the shoe of the card-handling devices 104. The captured image may be the "front" of the card that may indicate, for example, a rank or value of the card and a suit symbol of the card. Using a standard deck of cards, the rank of the card may be 2-10, Jack, Queen, King, or Ace, and the suit symbol may be Clubs, Spades, Hearts, or Diamonds. The suit symbol may also be identifiable by color (e.g., black and red for a standard deck). Other characteristics of the cards may also be indicated from the captured image, particularly for sets of cards using modified cards from a standard deck or alternative cards altogether. The card sensor 122 may be configured to generate rank data and/or suit symbol data for storage and analysis by the controller and/or the sensor system 108 as described herein.

The device sensors 124 are configured to monitor devices and components of the system 100 to track gameplay, device performance, and/or maintenance diagnostics of the monitored devices. In addition to reporting to the external system 101 using sensor data from the device sensors 124, the controller 106 may adjust control parameters of the devices within the system 100 based on the sensor data from the device sensors 124.

The dealer interface 110 is communicatively coupled to the controller 106 to enable a dealer to provide input to the controller 106 and/or to receive information from the controller 106. For example, the dealer interface 110 may be used by the dealer to input or confirm occupied player positions, wagers, wager amounts, and/or the conclusion of a wager period. In another example, the dealer interface presents wager outcomes on a round of play of the baccarat gameplay and any secondary wagers described herein. In certain embodiments, the dealer interface 110 is integrated with the controller 106 and/or other components of the system 100, such as the shoe of the card-handling devices 104.

The player interfaces 112 may be positioned around the gaming area 102 to provide information to the players (e.g., payout information, statistics, etc.) and/or receive input from the players. For example, rather than placing physical tokens within the gaming area 102, the player may input a wager to the player interface 112. The player interfaces 112 are communicatively coupled to the controller 106 and/or the dealer interface 110 to receive information and transmit input from players. In some embodiments, the player interfaces 112 are not divided between the player positions, but rather are shared displays viewed by all of the players. For example, the player interface 112 may be digital signage positioned near the gaming area 102 that presents visual indication of the payouts after a round of the baccarat game. In certain embodiments, one or more of the player interfaces 112 may not be located at the gaming area 102. That is, the player interfaces 112 may be remotely or independently located from the gaming area 102 to enable the players to participate in the game administered by the system 100 without actually being present at the gaming area. The player interfaces 112 may be communicatively coupled to the controller 106 and/or another suitable device (e.g., a server system that administers the game). In some embodiments, the player interface 112 may be a device owned by the player, such as a phone, tablet, or laptop, that accesses an online interface of the system 100 for play of the game.

In the example embodiment, the system 100 is configured to administer a baccarat game. More specifically, the system 100 is configured to administer a baccarat game including a secondary wager feature employing unique identifiers shared by the gaming area 102 and the set of cards. In one example, the unique identifier is tied to the player position occupied by the player and can be matched with a rank from the set of playing cards. That is, if a player places a secondary wager, during play of the baccarat game, the player's unique identifier is compared to at least one set of drawn cards (e.g., the player's and the dealer's initially dealt hands), and, if the unique identifier matches or is equal to the rank of two or more cards in a set of drawn cards, a payout is awarded to the player based on the secondary wager and a payout table associated with the secondary wager feature.

Figure 2:
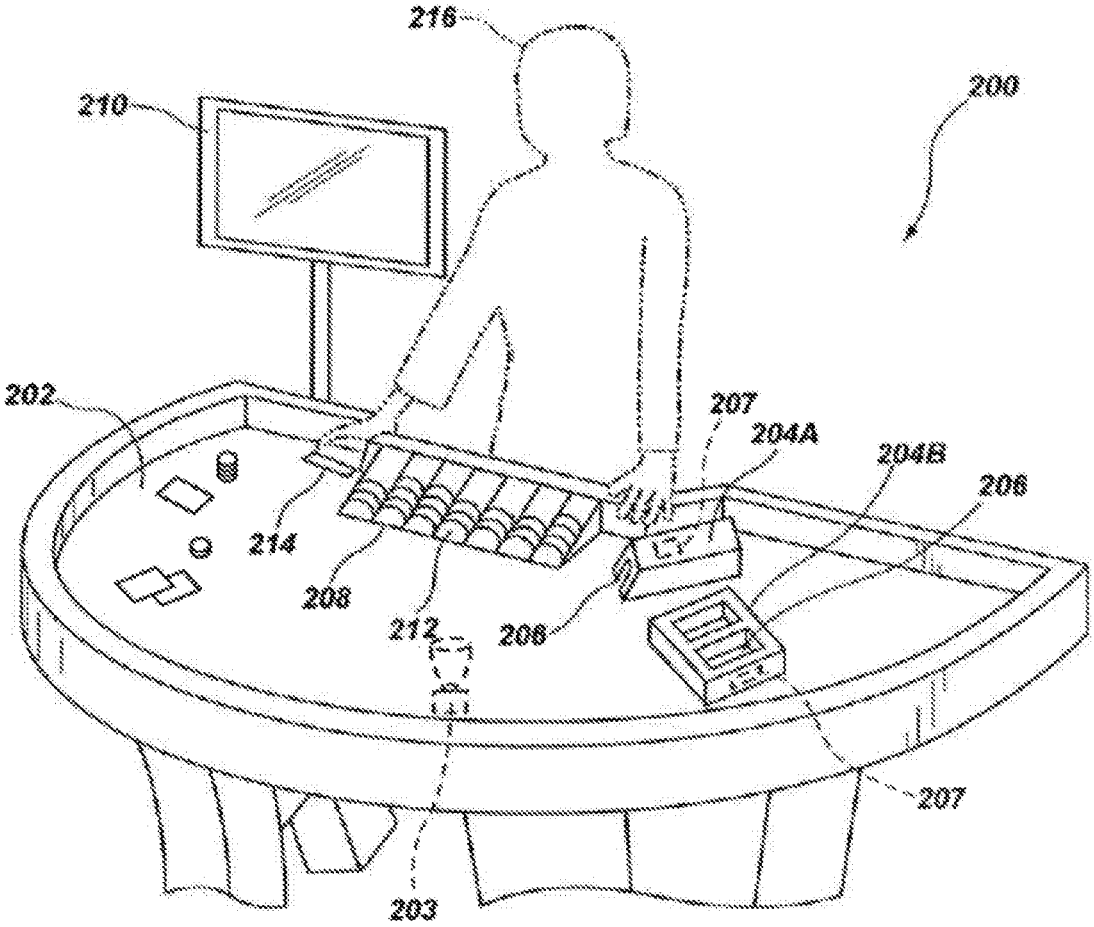
FIG. 2 is a perspective view of a gaming table configured for implementation of embodiments of wagering games in accordance with at least one embodiment of this disclosure.

FIG. 2 is a perspective view of an embodiment of a gaming table 200 for implementing wagering games in accordance with this disclosure. The gaming table 200 may be a physical article of furniture around which participants in the wagering game may stand or sit and on which the physical objects used for administering and otherwise participating in the wagering game may be supported, positioned, moved, transferred, and otherwise manipulated. For example, the gaming table 200 may include a gaming surface 202 on which the physical objects used in administering the wagering game may be located. The gaming surface 202 may be, for example, a felt fabric covering a hard surface of the table, and a design, conventionally referred to as a "layout," specific to the game being administered may be physically printed on the gaming surface 202. As another example, the gaming surface 202 may be a surface of a transparent or translucent material (e.g., glass or Plexiglas) onto which a projector 203, which may be located, for example, above or below the gaming surface 202, may illuminate a layout specific to the wagering game being administered. In such an example, the specific layout projected onto the gaming surface 202 may be changeable, enabling the gaming table 200 to be used to administer different variations of wagering games within the scope of this disclosure or other wagering games. Additional details of illustrative gaming surfaces and projectors are disclosed in U.S. patent application Ser. No. 13/919,849, filed Jun. 17, 2013, and titled "ELECTRONIC GAMING DISPLAYS, GAMING TABLES INCLUDING ELECTRONIC GAMING DISPLAYS AND RELATED ASSEMBLIES, SYSTEMS AND METHODS," the disclosure of which is incorporated herein in its entirety by this reference. In either example, the gaming surface 202 may include, for example, designated areas for player positions; areas in which one or more of player cards, banker cards, dealer cards, or community cards may be dealt; areas in which wagers may be accepted; areas in which wagers may be grouped into pots; and areas in which rules, pay tables, and other instructions related to the wagering game may be displayed. As a specific, non-limiting example, the gaming surface 202 may be configured as shown in FIG. 4 as described herein.

In some embodiments, the gaming table 200 may include a display 210 separate from the gaming surface 202. The display 210 may be configured to face players, prospective players, and spectators and may display, for example, rules, pay tables, real-time game status, such as wagers accepted and cards dealt, historical game information, such as amounts won, amounts wagered, percentage of hands won, and notable hands achieved, and other instructions and information related to the wagering game. The display 210 may be a physically fixed display, such as a poster, in some embodiments. In other embodiments, the display 210 may change automatically in response to a stimulus (e.g., may be an electronic video monitor).

The gaming table 200 may include particular machines and apparatuses configured to facilitate the administration of the wagering game. For example, the gaming table 200 may include one or more card-handling devices 204. The card-handling device 204A may be, for example, a shoe from which physical cards 206 from one or more decks of playing cards may be withdrawn, one at a time or more than one at a time. More specifically, the card-handling device 204 may be, for example, a mechanized, automatic shoe (i.e., a shoe including an internal, electromechanical, self-acting mechanism to handle card movement within the shoe, present cards for withdrawal, and optionally identify cards) or a non-mechanized shoe. Such a card-handling device 204A may include, for example, a housing in which cards 206 are located, an opening from which cards 206 are removed, and a card-presenting mechanism (e.g., a moving weight on a ramp configured to push a stack of cards down the ramp) configured to continually present new cards 206 for withdrawal from the shoe. Additional details of an illustrative card-handling device 204A configured as a shoe are found in U.S. Patent App. Pub. No. 2010/0038849, published Feb. 18, 2010, and titled "INTELLIGENT AUTOMATIC SHOE AND CARTRIDGE," the disclosure of which is incorporated herein in its entirety by this reference.

The card-handling device 204B may be, for example, a shuffler configured to reorder physical cards 206 from one or more decks of playing cards and present randomized cards 206 for use in the wagering game. Such a card-handling device 204B may include, for example, a housing, a shuffling mechanism configured to shuffle cards, and card inputs and outputs (e.g., trays). More specifically, the card-handling device 204B may be, for example, a batch shuffler, a continuous shuffler, or a combination shuffler and shoe. Additional details of an illustrative card-handling device 204B configured as a shuffler are found in U.S. Pat. No. 8,070,574, issued Dec. 6, 2011, to Grauzer et al., the disclosure of which is incorporated herein in its entirety by this reference. Shufflers such as the devices disclosed in the '574 Patent may include card recognition capability. Additionally, game rules may also be programmed within the shuffler such that the processor of the shuffler is capable of identifying a winning wager prior to automatic delivery of cards for resolving the wager into a shoe or other card delivery device. As a specific, non-limiting example, the card-handling device 204 may be a combination shuffler and shoe in which the output for the shuffler is a shoe.

In some embodiments, the card-handling device 204 may be configured and programmed to administer at least a portion of a wagering game being played utilizing the card-handling device 204. For example, the card-handling device 204 may be programmed and configured to present one or more cards for use according to game rules. More specifically, the card-handling device 204 may be programmed and configured to, for example, contain a randomized set of cards including one or more 52-card decks of standard playing cards and, optionally, any specialty cards (e.g., a cut card, bonus cards, wild cards, or other specialty cards). In some embodiments, the card-handling device 204 may present individual cards, one at a time, for withdrawal from the card-handling device 204. In some such embodiments, the card-handling device 204 may accept dealer input, such as, for example, a number of hit cards to draw. The game rules may be programmed into the memory of the card-handling device 204. As specific, non-limiting examples, the card-handling device 204 may present a cards one at a time for withdrawal, a dealer drawing two cards to deal to each of the player hand and the banker hand, and optionally one or more third cards to deal to one or both of the player hand and the banker hand according to dealing rules, as described above in connection with FIG. 1. The rules may be programmed into the device so that an instruction to deal or not deal a hit card to each hand may be displayed on a display device associated with the card handling device.

In some embodiments, the card-handling device 204 may employ a random number generator device to determine card order, such as, for example, a final card order or an order of insertion of cards into a compartment configured to form a packet of cards. The compartments may be sequentially numbered, and a random number assigned to each compartment number prior to delivery of the first card. In other embodiments, the random number generator may select a location in the stack of cards to separate the stack into two sub-stacks, creating an insertion point within the stack at a random location. The next card may be inserted into the insertion point. In yet other embodiments, the random number generator may randomly select a location in a stack to randomly remove cards by activating an ejector.

Regardless of whether the random number generator is hardware or software, it may be used to implement specific game administrations methods of the present disclosure. A suitable device employing random number generation for card management and randomization is marketed under the name MD3® by Bally Gaming, Inc. of Las Vegas, Nev. Aspects of this device are described in U.S. Pat. No. 8,579,289, issued Nov. 12, 2013, to Rynda et al., and the shuffling mechanism is fully described in U.S. Pat. No. 7,677,565, issued Mar. 16, 2010, to Grauzer et al., the disclosure of each of which is incorporated herein in its entirety by this reference.

The card-handling device 204 may simply be supported on the gaming surface 202 in some embodiments. In other embodiments, the card-handling device 204 may be mounted into the gaming table 202 such that the card-handling device 204 is not manually removable from the gaming table 202 without the use of tools. In some embodiments, the deck or decks of playing cards used may be standard, 52-card decks. The shuffler may also be configured to handle and dispense security cards, such as cut cards.

In some embodiments, the card-handling device 204 may include an electronic display 207 for displaying information related to the wagering game being administered. For example, the electronic display 207 may display a menu of game options, the name of the game selected, the number of cards per hand to be dispensed, acceptable amounts for wagers (e.g., maximums and minimums), numbers of cards to be dealt to recipients, locations of particular recipients for particular cards, winning and losing wagers, pay tables, winning hands, losing hands, and payout amounts. In other embodiments, information related to the wagering game may be displayed on another electronic display, such as, for example, the display 210 described previously.

The type of card-handling device 204 employed to administer embodiments of the disclosed wagering game, as well as the type of card deck employed and the number of decks, may be specific the game to be implemented. Cards used in games of this disclosure may be, for example, standard playing cards from one or more decks, each deck having cards of four suits (clubs, hearts, diamonds, and spades) and of rankings ace, king, queen, jack, and ten through two in descending order. As a more specific example, one, two, six, seven, or eight standard decks of such cards may be intermixed. Typically, six or eight decks of 52 standard playing cards each may be intermixed and formed into a set. In some embodiments, randomization of the cards may occur off-site, such as, for example, by purchasing the set of cards in its randomized form and introducing the randomized set of cards into the card-handling device 204 for delivery. In other embodiments, the cards may be randomized on-site before, during, or both before and during administration of the wagering game. For example, the set of cards may be randomized in a batch shuffler and introduced into a shoe for dealing or the set of cards may be continuously shuffled by a continuous shuffler, introduced in sets into a shoe integral to the continuous shuffler, withdrawn from the shoe and used for game play, and finally reintroduced into the continuous shuffler. After randomization, the set of cards may be transferred into another portion of the card-handling device 204 or another card-handling device 204 altogether, such as a mechanized shoe capable of reading card rank and suit. More specifically, the shoe disclosed in, for example, U.S. Pat. No. 8,511,684, issued Aug. 20, 2013, to Grauzer et al., the disclosure of which is incorporated herein in its entirety by this reference, may be used to automatically dispense one or more cards at a time from the randomized set.

In some embodiments, the wagering game may be hand-pitched. For example, a live, in-person dealer may deal cards from a set not located in a card-handling device. In some such embodiments, the dealer may also randomize the cards by hand-shuffling the set of cards.

As a specific, non-limiting example, the card-handling device 204 may be configured to shuffle at least a physical deck of 52 standard playing cards. As further specific, non-limiting examples, the card-handling device 204 may be configured to shuffle six physical decks of 52 standard playing cards, or eight physical decks of 52 standard playing cards. In some embodiments, additional cards may be included in the deck, e.g., security cards such as a cut card. As a specific, non-limiting example, the card-handling device 204 may be a card shuffler or a combination card shuffler and shoe configured to randomize and present cards (e.g., in groups or one at a time) from at least a 52-card deck of physical playing cards as described above.

The gaming table 200 may include one or more chip racks 208 configured to facilitate accepting wagers, transferring lost wagers to the house, and exchanging monetary value for wagering elements 212 (e.g., chips). For example, the chip rack 208 may include a series of token support rows, each of which may support tokens of a different type (e.g., color and denomination). The drop box 214 may be, for example, a secure container (e.g., a safe or lockbox) having a one-way opening into which money may be inserted and a secure, lockable opening from which money may be retrieved. Such drop boxes 214 are known in the art, and may be incorporated directly into the gaming table 200 and may, in some embodiments, have a removable container for the retrieval of money in a separate, secure location.

When administering a wagering game in accordance with embodiments of this disclosure, a dealer 216 may receive money (e.g., cash) from a player in exchange for wagering elements 212. The dealer 216 may deposit the money in the drop box 214 and transfer physical wagering elements 212 to the player. The dealer 216 may accept one or more initial wagers (e.g., antes and other wagers) from the player, which may be reflected by the dealer 216 permitting the player to place one or more wagering elements 212 or other wagering tokens (e.g., cash) within designated areas on the gaming surface 202 associated with the various wagers of the wagering game. Once initial wagers have been accepted, the dealer 216 may remove physical cards 206 from the card-handling device 204 (e.g., individual cards, packets of cards, or the complete set of cards) in some embodiments. In other embodiments, the physical cards 206 may be hand-pitched (i.e., the dealer 216 may optionally shuffle the cards 206 to randomize the set and may hand-deal cards 206 from the randomized set of cards). The dealer 216 may position cards 206 within designated areas on the gaming surface 202, which may designate the cards 206 for use as individual player cards, community cards, or dealer cards in accordance with game rules.

After dealing the cards 206, and during play, according to the game rules, any additional wagers (e.g., play bets) may be accepted, which may be reflected by the dealer 216 permitting the player to place one or more wagering elements 212 within designated areas on the gaming surface 202 associated with the various wagers of the wagering game. Finally, the dealer 216 may resolve the wagers, award-winning wagers to the players, which may be accomplished by giving wagering elements 212 from the chip rack 208 to the players, and transferring losing wagers to the house, which may be accomplished by moving wagering elements 212 from the players to the chip rack 208.

Figure 3:
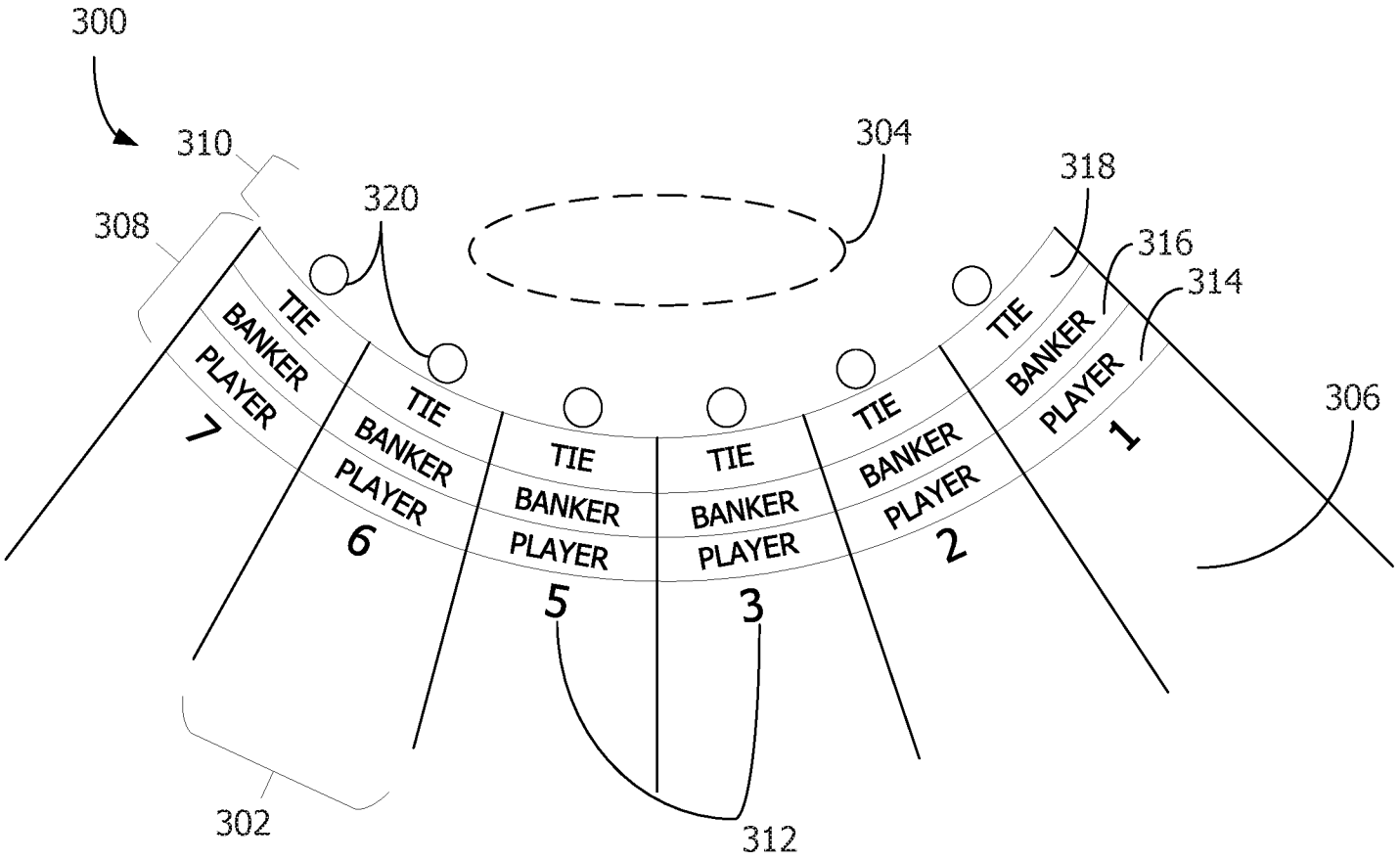
FIG. 3 is a diagram of an example playing surface layout for administering a wagering game in accordance with at least one embodiment of this disclosure.

FIG. 3 is an example layout 300 of an example gaming area (e.g., the gaming area 102, shown in FIG. 1) according to at least some embodiments for administering a baccarat game. Other layouts, such as layouts accommodating different numbers of players or for games other than baccarat may be used with similar or the same aspects as the layout 200 as described herein. The layout 300 may be overlaid on the gaming surface 202 at a gaming table 200 (both shown in FIG. 2).

In the example embodiment, the layout 300 includes a plurality of player positions 302, a dealer area 304, a card area 306, a primary wager area 308, and a secondary wager area 310. The markings or indicia used to distinguish between the areas of the layout 300 are for exemplary purposes only; it is to be understood that other suitable configurations of the indicia may be used.

Each player position 301 may be occupied by a player to play the baccarat card game. In the example embodiment, the baccarat game is Mini-Baccarat, which is distinguished from standard-rules baccarat by the dealer being the permanent banker rather than the players alternating the banker. The player positions 302 are oriented around the dealer area 304. Each player position 302 is associated with a unique identifier. In the example embodiment, the unique identifier is a seat or position number, and each player position includes identifier indicia 312 for visibly conveying the unique identifier of each player position 302. In the illustrated embodiment, the six player positions 302 have respective unique identifiers from 1 up to 7, where 4 is skipped because 4 may be considered an unlucky number in baccarat games. As described in detail further below, the unique identifiers may be used for play of a secondary wager feature.

The dealer area 304 may be defined by indicia or the dealer area 304 may rather be simply defined as by the absence of indicia from the other areas of the layout 300. In some embodiments, the dealer area 304 may be subdivided (e.g., via indicia on the layout 300) to define particular areas for equipment, such as a shoe, shuffler, or token tray.

The card area 306, the primary wager area 308, and the secondary wager area 310 are divided between each player position 302 such that cards, wagers, and the like can be distinguished between each player position 302. The card area 306 is a location configured to receiving dealt cards from the dealer. The card area 306 may also be occupied by each player's tokens, drinks, and other objects. In the example embodiment, the identifier indicia 312 is positioned within the card area 306.

The primary wager area 308 is configured to receive player's primary bets or wagers according to standard or base rules of baccarat as described in detail further below. The primary wager area 308 includes a player wager area 314, a banker wager area 316, and a tie wager area 318 for each player position 302. Tokens placed in the primary wager area 308 are primary wagers for a particular round of the game, and payouts for the primary wager are evaluated and provided based on the primary wager amount and which area the tokens were placed in (i.e., the player wager area 314, the banker wager area 316, or the tie wager area 318). In certain embodiments, one or more bet sensors (e.g., bet sensors 120, shown in FIG. 1) are configured to monitor the primary wager area 308 for the presence and/or value of wagers The secondary wager area 310 is configured to receive one or more secondary wagers for participation or play in one or more secondary game features. That is, a player gains eligibility to the secondary game features in exchange for the secondary wagers. In certain embodiments, the secondary game feature has additional, fewer, or alternative eligibility requirements. For example, gameplay performance in the primary game feature may be factored into the player's eligibility for the secondary game feature. In another example, players are automatically eligible to participate in the secondary game feature.

In some embodiments, the secondary game feature is based on gameplay of the primary game feature. For example, the secondary game feature of a card-based primary game may include determining whether or not a particular card or combination of cards has been dealt. In other embodiments, the secondary game feature is administered at least partially independent of the primary game feature. For example, additional cards that do not impact the primary game feature may be dealt and evaluated, alone or in combination with cards from the primary game feature, for the secondary game feature. In another example, the primary game feature may be administered using physical cards, while the secondary game feature may be administered graphically on a display device. As mentioned above, several secondary game features may be provided, and at least some may be administered concurrently to each other and/or the primary game feature.

The secondary wager area 310 may be divided to visually distinguish between wagers from each player and/or, in embodiments including a plurality of secondary game features, to distinguish between the different secondary game features that the player may provide a wager towards. That is, the layout 300 may include markings or indicia to provide the visual distinction. In certain embodiments, the markings or indicia in the secondary wager area 310 may not merely provide visual distinct, but also direct the players to place their secondary wagers in predetermined locations of the layout 300 for detection by one or more bet sensors (e.g., the bet sensors 120, shown in FIG. 1).

In the example embodiment, the secondary wager area 310 includes a respective secondary sensor area 320 for each player. The secondary sensor area 320 is associated with one or more bet sensors 120 that detect at least the presence of a secondary wager placed within the secondary sensor area 320 and, in some embodiments, a value of the placed secondary wager. In on example, at least one bet sensor 120 is positioned below the secondary sensor area 320. In another example, at least one bet sensor 120 is oriented to capture one or more images of the secondary sensor area 320, which may then be analyzed using object detection and image analysis techniques for detecting the presence and/or value of the secondary wager.

Referring to FIG. 4, a flowchart diagram of a method 400 of administering a wagering game is shown. Although a baccarat game is the example game used in the method 400, it is to be understood that the method 400 may be adapted for use with other types of games. Moreover, the method 400 is described with respect to a baccarat game that is primarily (or solely) administered using physical game elements at a physical gaming table. It is to be understood that other environments, such as hybrid games (e.g., games administered partially via physical game elements and partially via virtual or digital game elements) and virtual games. The method 400 may include accepting a baccarat wager or primary wager from each player (e.g., bettor or participant) to play a game of baccarat, as indicated at operation 402. For example, the primary wager may be a bet that a score of a banker hand will be greater than a score of a player hand, a bet that a score of the banker hand will be less than the score of the player hand, or a bet that the score of the banker hand will be equal to the score of the player hand (i.e., a bet that the banker hand and the player hand will tie). The score of the banker hand and the score of the player hand may be determined by modulo-ten scoring, as described in detail below. The primary wager may be accepted, for example, by a dealer physically receiving money, by receiving a physical representation of money (e.g., a chip or token) indicating a wager has been placed, or by receiving electronic authorization to charge a player account (e.g., a credit account or a bank account). More specifically, the primary wager may be accepted, for example, by physically receiving chips within one of three designated primary wager areas 314, 316, or 318 on a layout 300 (each shown in FIG. 3) presented on a playing surface of a gaming table 200 (shown in FIG. 2); by automatically detecting (e.g., using sensors, such as, for example, optical or RFID sensors) the presence of chips within the designated primary wager areas 314, 316, or 318; or by receiving electronic authorization at a processor (e.g., the processor 114, shown in FIG. 1) to charge a player account.

In one gameplay example, a bet by a player that the score of the player hand will be greater than the score of the banker hand may be accepted by receiving a physical, monetarily valuable wagering element (e.g., a token) in the designated wager area 314. Similarly, a bet by a player that the score of the banker hand will be greater than the score of the player hand may be accepted by receiving the physical, monetarily valuable wagering element in the designated banker wager area 316. A bet by a player that the score of the banker hand will be equal to the score of the player hand may be accepted by receiving the physical, monetarily valuable wagering element in the designated tie wager area 318.

The outcome upon which the player's wager is placed (i.e., banker hand wins, player hand wins, or tie) may be indicated to the player and/or dealer, as non-limiting examples, by visual indicators in communication with sensors configured to detect presence of chips within the designated primary wager areas 314, 316, or 318, as described above, or by visual indicators associated with a player interface (e.g., player interface 112, shown in FIG. 1), and activated in response to a player hand, banker hand, or tie wager input accepted at a processor of a computing device.

As indicated at operation 404, one or more side or secondary wagers may be accepted from the player. In general, characteristics of the cards, the layout, and/or other aspects may be compared and evaluated to determine an outcome of the secondary wager. For example, one or more side wagers may be a bet related to the occurrence of a particular player hand, a particular banker hand, or combinations thereof. In such an example, the occurrence of a particular combination of cards from the player hand and the banker hand may be compared to a unique identifier of the layout as described herein. As another example, one or more secondary wagers may be a bet related to the occurrence of a particular difference in score between the player hand or the banker hand. As yet another example, one or more secondary wagers may be a bet related to the occurrence of a particular player hand or banker hand and a score of the particular player hand or banker hand. Finally, one or more secondary wagers may be a bet related to the occurrence of a particular player hand or banker hand and the occurrence of a particular game result. The secondary wagers may be accepted from the player by performing any of the acts described above in connection with accepting the primary wager.

In the example embodiment, a secondary game feature is provided in combination with the play of a baccarat game, and players participate in the secondary game feature by providing a secondary wager. In at least some embodiments, the secondary wager may be detected by one or more bet sensors and attributed to an associated player. The secondary game feature in the example embodiment includes comparing at least the rank of a set of drawn cards (e.g., the player's and the dealer's initially dealt hands) to the unique identifier 312 (shown in FIG. 3) of the player providing the secondary wager.

In some embodiments, a progressive side wager may be received from the player as operation 406 or as an additional operation. The progressive side wager may be a bet that a winning condition related to one, some, or all of the number of cards in the player hand, the number of cards in the banker hand, the point score of the player hand, and the point score of the banker hand will occur. For example, a winning condition may be that the player hand, the banker hand, or both, contain three cards and exhibit a point score of seven. In some embodiments, a payout based on the progressive side wager may be paid to the player regardless of whether the player hand or banker hand wins or a tie occurs. In the example embodiment, the progressive side wager may be associated with the secondary game feature. That is, additional conditions within the context of the secondary game feature may be evaluated to determine whether or not to award the player with a progressive payout.

Any progressive side wagers accepted may be pooled in a progressive pot, which may be linked to a group of players playing the wagering game. For example, all progressive side wagers received from players at the same table, from players at a grouping of tables, from players at a grouping of electronic gaming machines administering the baccarat game, from players connected to a game service administering the baccarat game, from players physically located at a gaming establishment, from players remotely connected to a gaming establishment, or from all players participating in the wagering game at multiple gaming establishments may be pooled into a progressive pot. The progressive side wager may be accepted by performing any of the acts described above in connection with the baccarat wager. In examples in which the progressive wager is detected by positioning a wagering element on a layout, the layout may include indicia to mark an area for the progressive wager. In certain embodiments, at least one bet sensor may be positioned and configured to detect the presence and/or value of the progressive wager. In other embodiments, participation into the progressive feature may be integrated with another game feature. For example, the secondary wager to participate in the secondary game feature may automatically cause the player to be eligible for a progressive jackpot.

The progressive pot may initially be seeded with a base amount. Portions of progressive wagers made by players may be added to the seeded base amount in the progressive pot, and those progressive wagers lost during gameplay may be maintained in the progressive pot, such that the amount in the progressive pot increases as players make and lose progressive wagers. After a payout of the entire progressive pot, for example, upon occurrence of a rank and suit color match as described below (an example progressive pot payout is shown in TABLE 1), the progressive pot may be paid out and the pot reseeded with the base amount. The base "seed" amount may be, in one embodiment, $10,000.

Once any wagers have been accepted from the participating players, cards may be dealt to form a two-card initial player hand and a two-card initial banker hand, as indicated at operation 408. Dealing the cards to the player hand and to the banker hand may involve, for example, placing physical playing cards in a card area 306 and a banker area 304, on the layout 300 (each shown in FIG. 3). The physical playing cards may be provided from an automatic card shuffler, a baccarat shoe, or from a device including both an automatic card shuffler and a baccarat shoe. Alternatively or additionally, dealing the cards may include electronically displaying rank and suit information (e.g., images, text, or both) of playing cards electronically assigned to the player hand and the banker hand. Cards are typically dealt from a shoe that holds 6-8 decks of intermixed cards.

Scoring of the player hand and the banker hand may be determined by modulo-ten scoring. For example, point values of cards may be Ace-1, 2-2, 3-3, 4-4, 5-5, 6-6, 7=7, 8=8, 9=9, 10=0, Jack=0, Queen=0, and King=0. Only the last digit of the sum of the point values is operative in the play of the game. In other words, a total point value of the cards would be read as 1=1, 2=2, 3=3 . . . 9-9, 10-0, 11-1, 12-2, 13-3 . . . 20=0, etc., to determine the score of the hand.

Depending on the score of the two-card initially dealt player hand and the score of the two-card initially dealt banker hand, one additional card may be dealt to the player hand, and one additional card may be dealt to the banker hand, according to known baccarat dealing rules as indicated at operation 410. The dealer will apply the dealing rules, and either deal or refrain from dealing an additional card to the player hand and to the banker hand according to the dealing rules.

As a non-limiting example, under the rules of conventional baccarat, if the two-card initially dealt player hand has a score of between zero (0) and five (5), one additional card is drawn and added to the two-card initially dealt player hand to form a three-card player hand. If the two-card initially dealt player hand has a score of six (6) or greater, the player hand will not be dealt an additional card (i.e., the player "stands"), and the two-card initially dealt hand is the player hand. When the player stands, rules for the banker may require that if the score of the two-card initially dealt banker hand is between zero (0) and five (5), one additional card is drawn and added to the banker hand to form a three-card banker hand. If the two-card initially dealt banker hand has a score of six (6) or greater and the player stands, the banker hand will not receive an additional card, and the two-card initially dealt hand is the banker hand. When the player draws, the rules for the banker may require that if the score of the two-card initially dealt banker hand is between zero (0) and two (2), one additional card is dealt to the banker hand to form a three-card banker hand. If the two-card initially dealt banker hand has a score of three (3) or greater, the banker hand will not be dealt an additional card, and the two-card initially dealt banker hand is the banker hand.

The primary wager may be resolved by comparing the score of the player hand with the score of the banker hand, as indicated at operation 412. A fixed-odds payout may be paid to a player from whom a wager on the banker hand was accepted when the score of the banker hand exceeds the score of the player hand. Similarly, a fixed-odds payout may be paid to a player from whom a wager on the player hand was accepted when the score of the player hand exceeds the score of the banker hand. Finally, a fixed-odds payout may be paid to a player from whom a wager on a tie was received when the score of the player hand is equal to the score of the banker hand. Paying a payout may comprise, for example, physically giving money or chips to the player or granting electronic authorization to transfer funds to a player account. More specifically, the payout may be paid, for example, by physically placing chips within a card area 306, by receiving electronic authorization at a processor via a dealer interface (e.g., dealer interface 110, shown in FIG. 1) to transfer funds from an account server to a player account, or automatically generating electronic authorization at the processor to transfer funds from an account server to a player account. Typically, the player wins 1:1 on the player and banker hands, and a higher odds payout if a tie bet is won.

The primary wager may also be resolved as operation 412 by declaring a banker hand bet a push when the point value of the banker hand exceeds the point value of the player hand, the banker hand consists of three cards, and the total point value of the hand is exactly 7 points. This set of conditions would normally result in the player winning the banker wager. By changing the outcome to a push, a house advantage is created, eliminating the need for the house to charge a commission on the winning banker bet. In other embodiments, a commission is charged on the game, and the bet is resolved in favor of the player.

Combining this game resolution with a separate secondary bet that pays based on the rank of the initially dealt hands and the unique identifier associated with each player may add additional winning opportunities and generate additional excitement to the players. Games that generate the most revenue for the casino are the games that are retained. Often a casino will ask for additional tables if a game is performing well. Providing table games with features that enable casino operators to increase revenue represents an advance in gaming technology.

Losing baccarat wagers may be collected for the house. Collecting the baccarat wager from the player may be accomplished, for example, by physically retrieving chips from designated primary wager areas 314, 316, and 318, receiving electronic authorization at a processor via a dealer interface to transfer funds from a player account to an account server, or automatically generating electronic authorization at the processor to transfer funds from an account server to a player account.

In conventional baccarat, the player may be required to pay a percentage of a payout on a winning wager on the banker hand to the house as commission. For example, in some conventional baccarat games, the player may be required to pay a 5% commission to the house on any payout from a wager placed on the banker hand. In embodiments of the disclosure, a winning wager on the banker hand where the banker hand has a predetermined score, a predetermined number of cards, or both, may push, and the commission may not be required to be paid by the player on winning wagers on the banker hand. As a non-limiting example, bets accepted from the player on the banker hand may push when the banker hand wins with a three-card hand exhibiting a score of seven. Eliminating the commission eliminates the need to calculate and collect commissions, and increases the speed with which each round of play is administered, increasing the profitability of the baccarat game by enabling more wagers to be placed per unit of time.

When baccarat wagers accepted from the player and placed on the banker hand result in a push, each baccarat wager placed on the banker hand may be returned to the respective players. Returning the baccarat wagers to the respective players may involve, for example, physically returning money or chips to a player or issuing electronic authorization to credit a player account.

Resolution of the secondary wager may occur before, simultaneously with, or after resolution of the primary wagers and other side wagers. In the example embodiment, at least one card sensor (e.g., card sensors 122, shown in FIG. 1) is configured to identify 414 at least a rank of each dealt card and generate 416 rank data indicating the identified ranks of the dealt cards. The rank data may be transmitted to a controller (e.g., the controller 106, shown in FIG. 1) for evaluation of the secondary game feature and resolution of the secondary wagers. In the example embodiment, the controller is configured to detect which players participating in the baccarat game are also participating in the secondary game feature for a particular round of play. In one example, at least one bet sensor detects the presence of a secondary wager in the secondary sensor area 320 (shown in FIG. 3). In another example, the dealer may manually enter the secondary wagers into a dealer interface, such as the dealer interface 110.

In either example, the controller may also associate the secondary wagers with respective unique identifiers associated with the players of the secondary wagers. In the example embodiment, the unique identifiers 312 (shown in FIG. 3) are numerical identifiers for each player position. As an example, if a player occupying the second player position (i.e., the position labeled "2" on the layout 300 shown in FIG. 3) provides a secondary wager, the controller may associate the secondary wager with the unique identifier "2".

In response to the controller receiving the rank data from the card sensor, the controller compares 418 the rank data to the unique identifiers associated with the secondary wagers. More specifically, the controller identifies how many (if any) of the initially dealt player and dealer hands (i.e., two cards apiece) have a rank that matches or is of equal rank to the unique identifiers. Based on the number of matches and the presences of the secondary wager, the player may be awarded 420 a payout for the secondary wager according to one or more pay tables of the secondary game feature and the controller may cause a visual indication of the payout to be displayed 422 on one or more display devices (e.g., a display device of the controller, the shoe, signage, the player interface, etc.). The payout may be a fixed-odds payout according to a pay table such that the payout is a function of the secondary wager and odds for the outcome as listed in a pay table for the secondary game feature. An example pay table is shown in TABLE 1 as a non-limiting example. The payout may be based on the value of the secondary wager and odds listed in a pay table. In other embodiments, particularly embodiments in which the value of the secondary wager is predetermined (e.g., the house specifies a secondary wager amount), the pay table may have fixed payouts. For example, at least some of the payouts shown in TABLE 1 may have a numerical value that may be considered lucky.

In the example shown in TABLE 1, a winning outcome of the secondary game feature is achieved by a player by (i) providing the secondary wager and (ii) at least two cards of the initially dealt hands have a rank that matches the unique identifier associated with the player. Increasing the number of matches from two cards with matching rank up to four cards with matching rank increases the payout for the secondary wager. Up to two players may achieve a winning outcome of the secondary game feature. That is, if the four cards drawn to be the initially dealt hands include two cards associated with a first player's unique identifier and two cards associated with a second player's unique identifier, both the first and second players may be awarded a payout for the secondary game feature.

As shown in TABLE 1, at least some embodiments may include payouts to the dealer in response to a player winning the secondary game feature, which may reduce or otherwise eliminate commissions in the primary baccarat game. Providing a payout to the dealer for winning outcomes may also foster a collaborative environment between the players and the dealers, which may enhance player excitement and participation in the secondary game feature. The dealer payment may be fixed or a function of the payout to the player. In other embodiments, the dealer may not receive a payout for winning outcomes of the secondary game feature.

As mentioned above, a progressive wager may be provided as part of the secondary game feature. In at least some embodiments, the card sensors identify one or more other characteristics beyond the rank of the dealt cards for determining whether or not to provide a progressive pot payout to the player. In the example embodiment, the card sensors identify a suit symbol of each drawn card and generate suit symbol data for the drawn cards for analysis by the controller. The suit symbol data may include, in examples including a standard deck of cards, indication of whether or not each card had a suit of "hearts", "diamonds", "spades", or "clubs". In certain embodiments, the suit symbol data may indicate a color, rather than or in addition to, the specific suit of a card, i.e., hearts and diamonds are "red", while spades and clubs are "black".

In the example embodiment, the color of the initially dealt hands are analyzed to identify whether or not the color of the cards matching the unique identifier also have a matching color. In particular, in TABLE 1, the color comparison may only be relevant when all four of the cards drawn to form the initially dealt hands have a rank that matches the unique identifier. In such an embodiment, a progressive jackpot may be awarded to the player in response to satisfying the conditions listed in TABLE 1 and providing at least the progressive wager. In certain embodiments, the secondary wager may also be required to be eligible for the progressive jackpot. In other embodiments, additional, fewer, or alternative conditions may be applied for awarding the progressive pot. In one example, one or more additional progressive winning conditions may be provided that offer a percentage of the progressive pot rather than the entirety of the pot. In another example, rather than color, the winning condition may require the drawn cards to have a matching suit rather than color.

TABLE 1

| Matching Cards | Pays | Dealer Payment |
|---|---|---|
| Four (Same Color) | Progressive Jackpot | $1,000 |
| Four | $8,888 | $250 |
| Three | $777 | $25 |
| Two | $66 | $5 |

Various platforms are contemplated that are suitable for implementation of embodiments of wagering games according to this disclosure. For example, embodiments of wagering games may be implemented as live table games with an in-person dealer, electronic gaming machines, partially or fully automated table games, and partially or fully automated, network-administered games (e.g., Internet games) wherein game results may be produced utilizing a processor or a live video feed of a dealer administering a game from a remote studio.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, on a legally authorized site on the Internet, or on a play-for-fun site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "GAMBLING GAME SYSTEM AND METHOD FOR REMOTELY-LOCATED PLAYERS," the disclosure of which is incorporated herein in its entirety by this reference.

Some embodiments may be implemented using a one or more electronic gaming devices that facilitate hybrid or electronic play of the game features described in FIG. 4. Further detail of an example of an individual electronic gaming device (as well as other embodiments of tables and devices) is disclosed in U.S. patent application Ser. No. 13/963,165, filed Aug. 9, 2013, and titled "METHODS AND SYSTEMS FOR ELECTRONIC GAMING," the disclosure of which is incorporated herein in its entirety by this reference. Other embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 5:
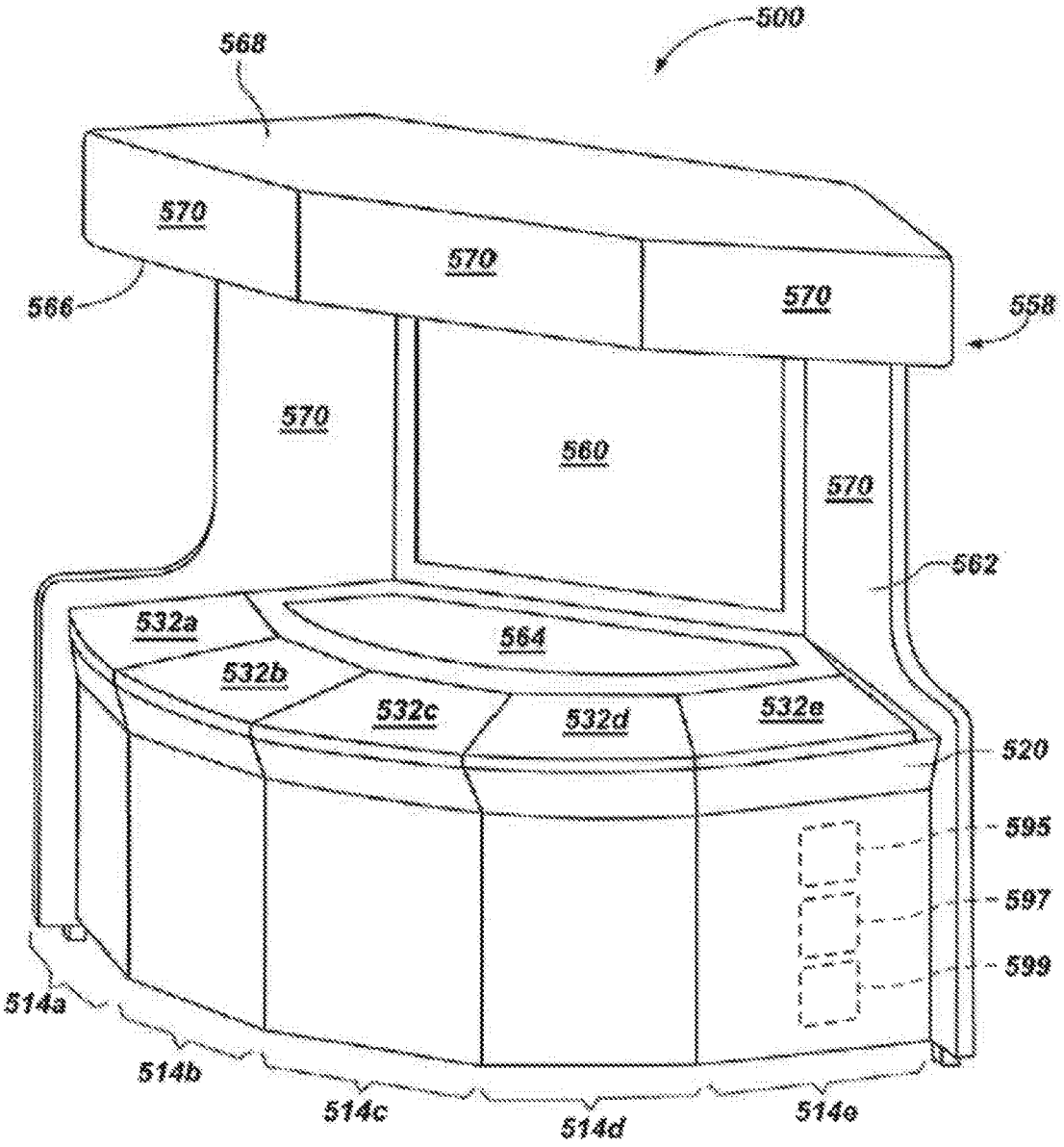
FIG. 5 is a perspective view of another embodiment of a table configured for implementation of embodiments of wagering games in accordance with this disclosure, wherein the implementation includes a virtual dealer.

FIG. 5 is a perspective view of another embodiment of a suitable table 500 configured for implementing wagering games according to the present disclosure utilizing a virtual dealer. The table 500 may include player positions 514 arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, any community cards, and player's cards by the virtual dealer on the dealer screen 560.

Each of the player positions 514 may include a player interface area 532 configured for wagering and game play interactions with the video device 558 and virtual dealer. Accordingly, game play may be accommodated without involving physical playing cards, poker chips, and live personnel. The action may instead be simulated by a control processor 597 interacting with and controlling the video device 558. The control processor 597 may be programmed, by known techniques, to implement the rules of game play at the video device 558. As such, the control processor 597 may interact and communicate with display/input interfaces and data entry inputs for each player interface area 532 of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices, such as a central server, through a suitable communication medium, such, as, for example, wired networks, Wi-Fi networks, and cellular communication networks.

The video device 558 may further include banners communicating rules of play and the like, which may be located along one or more walls 570 of the cabinet 562. The video device 558 may further include additional decorative lights and speakers, which may be located on an underside surface 566, for example, of a generally horizontally extending top 568 of the cabinet 562 of the video device 558 generally extending toward the player positions 514.

Further detail of an example of a table and player displays is disclosed in U.S. Pat. No. 8,272,958, issued Sep. 25, 2012, and titled "AUTOMATED MULTIPLAYER GAME TABLE WITH UNIQUE IMAGE FEED OF DEALER," the disclosure of which is incorporated herein in its entirety by this reference. Although an embodiment is described showing individual discrete player stations, in some embodiments, the entire playing surface (e.g., player interface areas 532, card screen 564, etc.) may be a unitary electronic display that is logically partitioned to permit game play from a plurality of players for receiving inputs from, and displaying game information to, the players, the dealer, or both.

Figure 6:
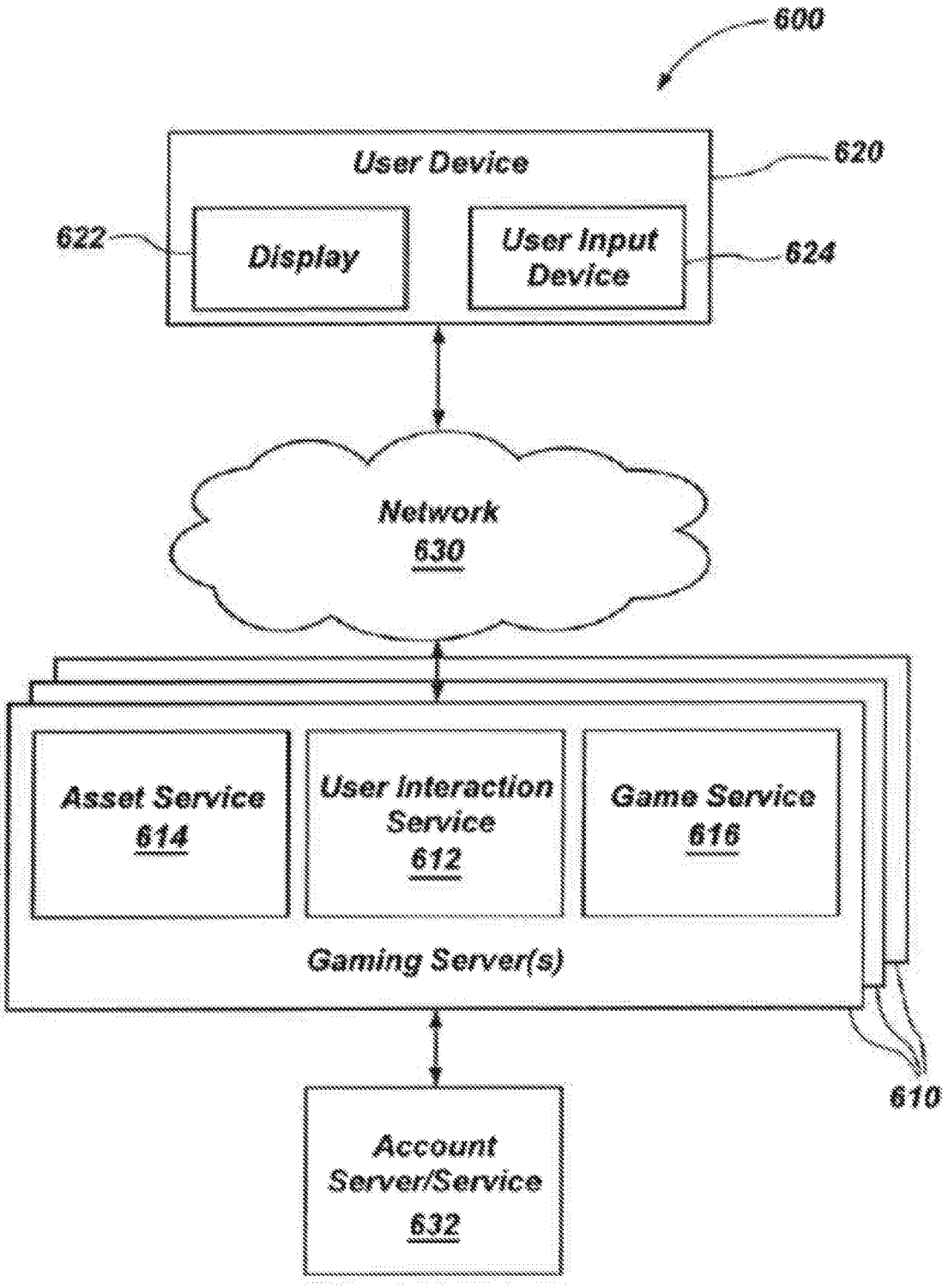
FIG. 6 is a schematic block diagram of a gaming system for implementing embodiments of wagering games in accordance with this disclosure.

In some embodiments, wagering games in accordance with this disclosure may be administered using a gaming system employing a client-server architecture (e.g., over the Internet, a local area network, etc.). FIG. 6 is a schematic block diagram of an illustrative gaming system 600 for implementing wagering games according to this disclosure. The gaming system 600 may enable end users to remotely access game content. Such game content may include, without limitation, various types of wagering games such as the baccarat variant game of the present disclosure, other card games, dice games, big wheel games, roulette, scratch off games ("scratchers"), and any other wagering game where the game outcome is determined, in whole or in part, by one or more random events. This includes, but is not limited to, Class II and Class III games as defined under 25 U.S.C. § 2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In some embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically, the user device is remote from the gaming server 610 and the network is the word-wide web (i.e., the Internet).

Figure 8:
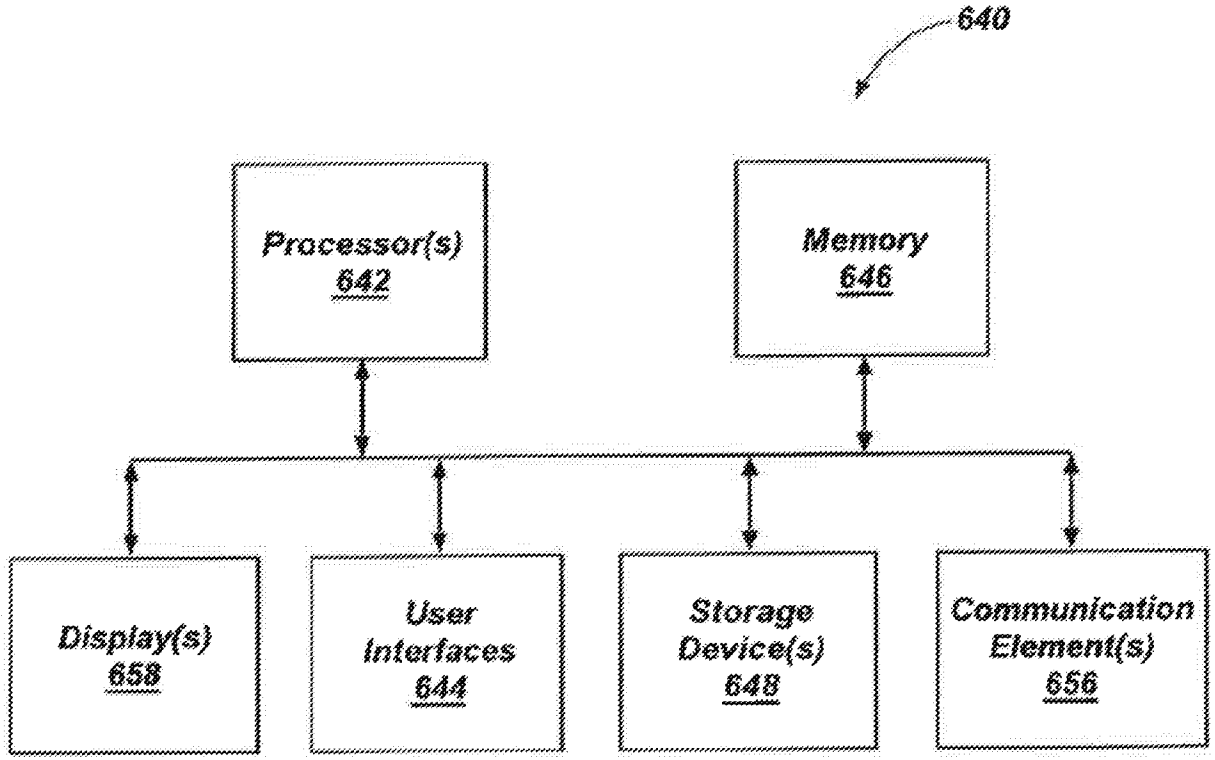
FIG. 8 is a block diagram of a computer for acting as a gaming system for implementing embodiments of wagering games in accordance with this disclosure.

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 8, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated by one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may, for example, access, interpret, and apply game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script (e.g., JAVASCRIPT®), also referred to as a "script driver," including scripting language that controls an interface of the client. The script driver may include simple function calls requesting information from the gaming servers 610. In other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such as baccarat variants of the present invention, such that the game service 616 controls some or all of the game flow for a selected wagering game as well as the determined game outcomes. The game service 616 may include pay tables and other game logic. The game service 616 may perform random number generation for determining random game elements of the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming device, as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity (e.g., a casino) may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself. Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations. For example, the gaming servers 610 may include additional features and configurations as described in U.S. patent application Ser. No. 13/353,194, filed Jan. 18, 2012, and U.S. patent application Ser. No. 13/609,031, filed Sep. 10, 2012, both applications titled "NETWORK GAMING ARCHITECTURE, GAMING SYSTEMS, AND RELATED METHODS," the disclosure of each of which is incorporated herein in its entirety by this reference.

Figure 7:
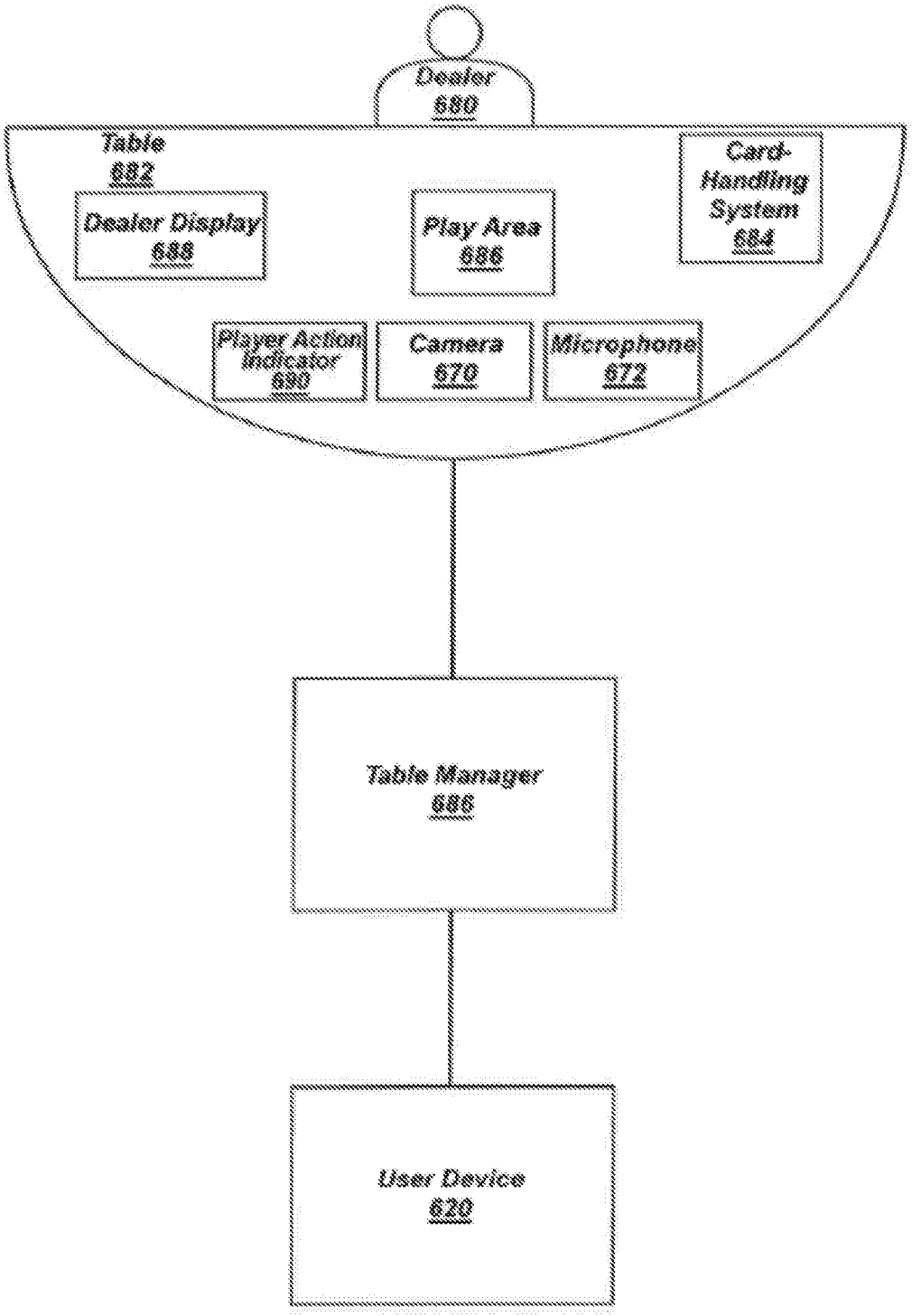
FIG. 7 is a schematic block diagram of a gaming system for implementing embodiments of wagering games including a live dealer feed.

FIG. 7 is a schematic block diagram of a table 682 for implementing wagering games including a live dealer feed. Features of the gaming system 600 (see FIG. 6) described above in connection with FIG. 7 may be utilized in connection with this embodiment, except as further described. Rather than cards being determined by computerized random processes, physical cards (e.g., from a standard, 52-card deck of playing cards) may be dealt by a live dealer 680 at a table 682 from a card-handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 (e.g., acting as the gaming system 600 itself or as an intermediate client interposed between and operationally connected to the user device 620 and the gaming system 600) to provide gaming at the table 682 to users of the gaming system 600. Thus, the table manager 686 may communicate with the user device 620 through a network 630 (see FIG. 6), and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600, such as the one shown and described in connection with FIG. 6. In some embodiments, the gaming system 600 may match remotely located players to tables 682 and facilitate transfer of information between user devices 620 and tables 682, such as wagering amounts and player option elections, without managing gameplay at individual tables. In other embodiments, functions of the table manager 686 may be incorporated into a gaming system 600.

The table 682 includes a camera 670 and optionally a microphone 672 to capture video and audio feeds relating to the table 682. The camera 670 may be trained on the dealer 680, play area 686, and card-handling system 684. The banker and player hands may be delivered to card play area 686. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table. Known image extraction techniques may be used to obtain card count and card rank and suit information from the card images. An example of suitable image extraction software is disclosed in U.S. Pat. No. 7,901,285, issued Mar. 8, 2011, to Tran et al., the disclosure of which is incorporated in this disclosure in its entirety by this reference.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example. Examples of card data include, for example, suit and rank information of a card, suit and rank information of each card in a hand, rank information of a hand, and rank information of every hand in a round of play.

The live video feed permits the dealer to show cards dealt by the card-handling system 684 and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

The card-handling system 684 may be as shown and described previously in connection with FIG. 2. The play area 686 depicts player positions for playing the game, such as shown in FIG. 3. As determined by the rules of the game, the player at the user device 620 may be presented options for responding to an event in the game using a client as described with reference to FIG. 6.

Player elections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card-handling system 684 to identify cards dealt by the card-handling system 684. For example, the card-handling system 684 may include a card reader to determine card information from the cards. The card information may include the rank and suit of each dealt card and hand information.

The table manager 686 may apply game rules to the card information, along with the accepted player wagering decisions, to determine gameplay events and wager results. Alternatively, the wager results may be determined by the dealer 680 and input to the table manager 686, which may be used to confirm automatically determined results by the gaming system.

Card and wager data in some embodiments may be used by the table manager 686 to determine game outcome. The data extracted from the camera 670 may be used to confirm the card data obtained from the card-handling system 684, to determine a player position that received a card, and for general security monitoring purposes, such as detecting player or dealer card switching, for example.

The live video feed permits the dealer to show cards dealt by the card-handling system 684 and play the game as though the player were at a live casino. In addition, the dealer can prompt a user by announcing a player's election is to be performed. In embodiments where a microphone 672 is included, the dealer 680 can verbally announce action or request an election by a player. In some embodiments, the user device 620 also includes a camera or microphone, which also captures feeds to be shared with the dealer 680 and other players.

FIG. 8 is a simplified block diagram showing elements of computing devices that may be used in systems and apparatuses of this disclosure. A computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure. The processors 642 may be configured as a general-purpose processor such as a microprocessor, but in the alternative, the general-purpose processor may be any processor, controller, microcontroller, or state machine suitable for carrying out processes of the present disclosure. The processor 642 may also be implemented as a combination of computing devices, such as a combination of a DSP and a microprocessor, a plurality of microprocessors, one or more microprocessors in conjunction with a DSP core, or any other such configuration.

A general-purpose processor may be part of a general-purpose computer. However, when configured to execute instructions (e.g., software code) for carrying out embodiments of the present disclosure the general-purpose computer should be considered a special-purpose computer. Moreover, when configured according to embodiments of the present disclosure, such a special-purpose computer improves the function of a general-purpose computer because, absent the present disclosure, the general-purpose computer would not be able to carry out the processes of the present disclosure. The processes of the present disclosure, when carried out by the special-purpose computer, are processes that a human would not be able to perform in a reasonable amount of time due to the complexities of the data processing, decision making, communication, interactive nature, or combinations thereof for the present disclosure. The present disclosure also provides meaningful limitations in one or more particular technical environments that go beyond an abstract idea. For example, embodiments of the present disclosure provide improvements in the technical field related to the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light-emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push-buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, THUNDERBOLT™ connections, BLUETOOTH® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially combined buses, or a common bus.

As a specific, non-limiting example, various methods and features of the present disclosure may be implemented in a mobile, remote, or mobile and remote environment over one or more of Internet, cellular communication (e.g., Broadband), near field communication networks and other communication networks referred to collectively herein as an iGaming environment. The iGaming environment may be accessed through social media environments such as FACEBOOK® and the like. DragonPlay Ltd, acquired by Bally Technologies Inc., provides an example of a platform to provide games to user devices, such as cellular telephones and other devices utilizing ANDROID®, iPHONE® and FACEBOOK® platforms. Where permitted by jurisdiction, the iGaming environment can include pay-to-play (P2P) gaming where a player, from their device, can make value based wagers and receive value based awards. Where P2P is not permitted, the features can be expressed as entertainment only gaming where players wager virtual credits having no value or risk no wager whatsoever such as playing a promotion game or feature.

Figure 9:
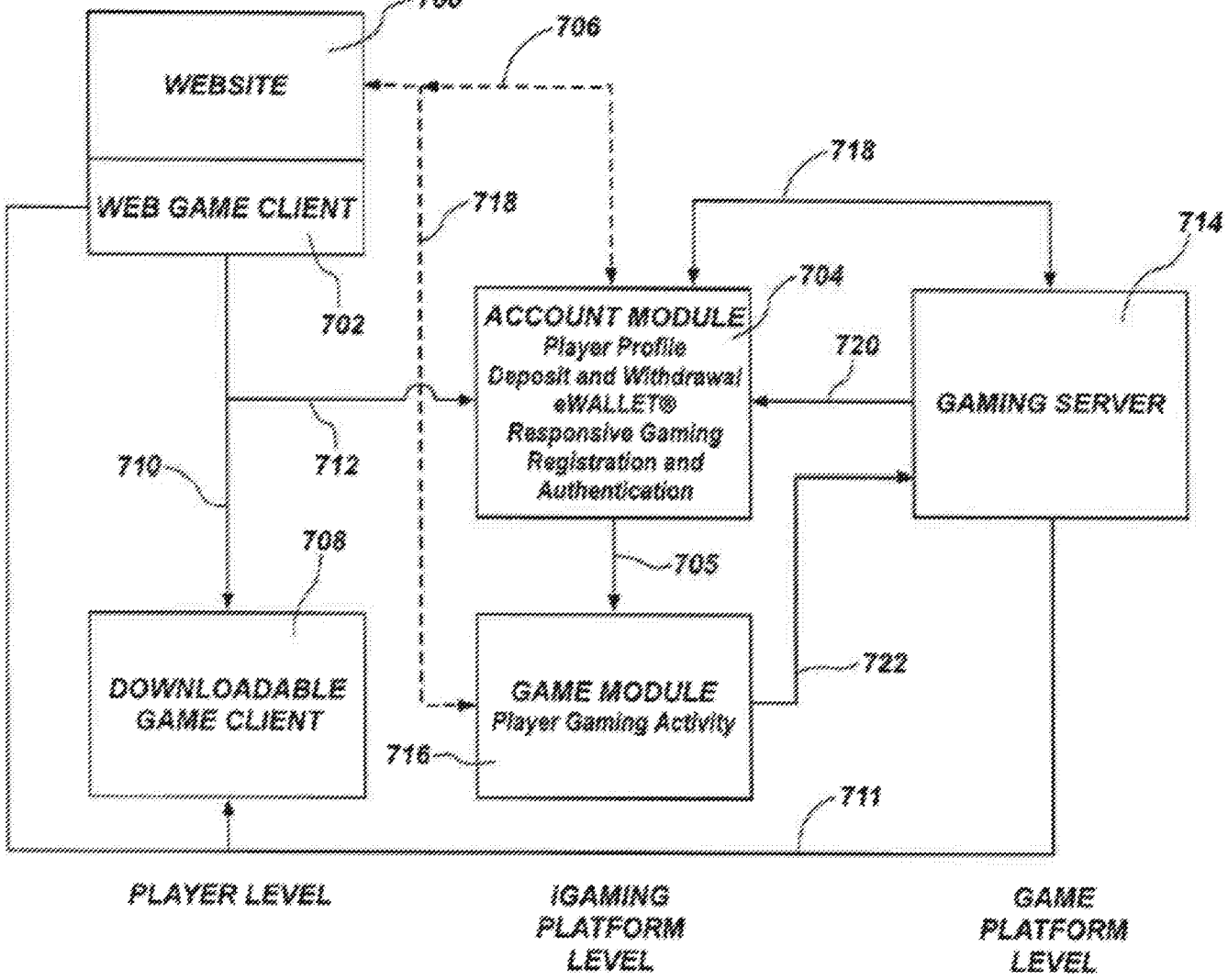
FIG. 9 illustrates an embodiment of data flows between various applications/services for supporting the game, feature or utility of the present disclosure for mobile/interactive gaming.

FIG. 9 illustrates an illustrative embodiment of information flows in another iGaming environment. At a player level, the player or user accesses a site hosting the activity such as a website 700. The website 700 may functionally provide a web game client 702. The web game client 702 may be, for example, represented by a game client 708 downloadable at information flow 710, which may process applets transmitted from a gaming server 714 at information flow 711 for rendering and processing game play at a player's remote device. Where the game is a P2P game, the gaming server 714 may process value-based wagers (e.g., money wagers) and randomly generate an outcome for rendition at the player's device. In some embodiments, the web game client 702 may access a local memory store to drive the graphic display at the player's device. In other embodiments, all or a portion of the game graphics may be streamed to the player's device with the web game client 702 enabling player interaction and display of game features and outcomes at the player's device.

The web site 700 may access a player-centric, iGaming-platform-level account module 704 at information flow 706 for the player to establish and confirm credentials for play and, where permitted, access an account (e.g., an eWallet) for wagering. The account module 704 may include or access data related to the player's profile (e.g., player-centric information desired to be retained and tracked by the host), the player's electronic account, deposit, and withdrawal records, registration and authentication information, such as username and password, name and address information, date of birth, a copy of a government issued identification document, such as a driver's license or passport, and biometric identification criteria, such as fingerprint or facial recognition data, and a responsible gaming module containing information, such as self-imposed or jurisdictionally imposed gaming restraints, such as loss limits, daily limits and duration limits. The account module 704 may also contain and enforce geo-location limits, such as geographic areas where the player may play P2P games, user device IP address confirmation, and the like.

The account module 704 communicates at information flow 705 with a game module 716 to complete log-ins, registrations, and other activities. The game module 716 may also store or access a player's gaming history, such as player tracking and loyalty club account information. The game module 716 may provide static web pages to the player's device from the game module 716 through information flow 718, whereas, as stated above, the live game content may be provided from the gaming server 714 to the web game client through information flow 711.

The gaming server 714 may be configured to provide interaction between the game and the player, such as receiving wager information, game selection, inter-game player selections or choices to play a game to its conclusion, and the random selection of game outcomes and graphics packages, which, alone or in conjunction with the downloadable game client 708/web game client 702 and game module 716, provide for the display of game graphics and player interactive interfaces. At information flow 718, player account and log-in information may be provided to the gaming server 714 from the account module 704 to enable gaming. Information flow 720 provides wager/credit information between the account module 704 and gaming server 714 for the play of the game and may display credits and eWallet availability. Information flow 722 may provide player tracking information for the gaming server 714 for tracking the player's play. The tracking of play may be used for purposes of providing loyalty rewards to a player, determining preferences, and the like.

All or portions of the features of FIG. 9 may be supported by servers and databases located remotely from a player's mobile device and may be hosted or sponsored by regulated gaming entity for P2P gaming or, where P2P is not permitted, for entertainment only play.

In some embodiments, wagering games may be administered without players risking money in connection with the wagers (i.e., "play-for-fun" games). Access to play-for-fun wagering games may be granted on a time period basis in some embodiments. For example, upon initially joining the wagering game, each player may automatically be given nonmonetary wagering elements, such as, for example, chips, points, or simulated currency, that are of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time access to another quantity of the wagering elements may be granted to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher-level players, or players who have invested more time playing the game may be allotted more wagering elements per unit of time than a player assigned to a lower level group.

Therefore, in some embodiments, the wagering game may be administered by receiving wagers (e.g., a baccarat wager on the player hand, the banker hand, or a tie) of no real-world monetary value, and payouts (e.g., payouts on the baccarat wager on the player hand, the banker hand, or a tie) may be paid without transferring real-world monetary value to the players. Such embodiments, referred to herein as "free play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

While certain illustrative embodiments have been described in connection with the figures, those of ordinary skill in the art will recognize and appreciate that the scope of this disclosure is not limited to those embodiments explicitly shown and described herein. Rather, many additions, deletions, and modifications to the embodiments described herein may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A system for administering a baccarat secondary bet, the system comprising:

a gaming table with multiple player positions;

a shoe containing a shuffled set of cards, the shoe including a delivery end through which cards from the set of cards are manually drawn and at least one card sensor configured to identify a rank of each drawn card and generate rank data indicating the identified rank of each drawn card; and a layout positioned on an upper surface of the gaming table and marked with indicia to indicate the multiple player positions, each player position marked with a unique identifier matching a rank of at least one subset of cards in the set of cards, a game controller communicatively coupled to the shoe and configured to:

receive the rank data for a set of four cards drawn in a game of baccarat from the shoe; and in response to determining that at least two of the four drawn cards have an equal rank that is equal to the unique identifier of one of the player positions and that a secondary wager has been registered for that unique identifier, provide a visual indication of a payout to a player at the one of the player positions.

2. The system of claim 1 further comprising at least one bet sensor in communication with the game controller, the at least one bet sensor configured to detect at least the presence of the secondary wager at the one of the player positions and generate wager sensor data associated with the unique identifier of the one of the player positions.

3. The system of claim 2, wherein the layout is marked with indicia indicating a primary wager area of the layout and a secondary wager area of the layout for each player position of the multiple player positions, wherein the at least one bet sensor is configured to monitor the secondary wager area associated with the one of the player positions for the secondary wager.

4. The system of claim 2, wherein the at least one bet sensor includes a plurality of bet sensors, and wherein the secondary wager area of the layout for each player position of the multiple player positions is monitored by a respective at least one bet sensor of the plurality of bet sensors.

5. The system of claim 1, wherein the set of four cards drawn in the game of baccarat includes two cards dealt to a dealer and two cards dealt to a player at one of the multiple player positions of the gaming table.

6. The system of claim 1, wherein the payout to the player varies at least partially as a function of a number of cards from the set of four cards drawn that have equal rank, wherein the payout increases in response to the number of cards having equal rank increasing.

7. The system of claim 6, wherein the at least one card sensor is configured to identify a suit symbol of each drawn card and generate suit symbol data, and wherein a progressive jackpot is awarded to the player at least partially in response to the suit symbol data of the set of four drawn cards indicating the set of four drawn cards have a matching suit symbol.

8. A method of administering a baccarat secondary bet using a system including (i) a gaming table with multiple player positions, (ii) a shoe containing a shuffled set of cards, (iii) a layout positioned on an upper surface of the gaming table and marked with indicia to indicate the multiple player positions, each player position marked with a unique identifier matching a rank of at least one subset of cards in the set of cards, and (iv) a game controller communicatively coupled to the shoe, the method comprising:

dispensing, by a delivery end of the shoe, cards manually drawn from the set of cards;

identifying, by at least one card sensor, a rank of each drawn card;

generating, by the at least one card sensor, rank data indicating the identified rank of each drawn card;

receiving, by the game controller, the rank data for a set of four cards drawn in a game of baccarat from the shoe; and in response to determining, by the game controller, that at least two of the four drawn cards have an equal rank that is equal to the unique identifier of one of the player positions and that a secondary wager has been registered for that unique identifier, providing a visual indication of a payout to a player at the one of the player positions.

9. The method of claim 8 further comprising detecting, via at least one bet sensor in communication with the game controller, at least the presence of the secondary wager at the one of the player positions and generating wager sensor data associated with the unique identifier of the one of the player positions.

10. The method of claim 9, wherein the layout is marked with indicia indicating a primary wager area of the layout and a secondary wager area of the layout for each player position of the multiple player positions, wherein the at least one bet sensor is configured to monitor the secondary wager area associated with the one of the player positions for the secondary wager.

11. The method of claim 8, wherein the set of four cards drawn in the game of baccarat includes two cards dealt to a dealer and two cards dealt to a player at one of the multiple player positions of the gaming table.

12. The method of claim 11, wherein the two cards dealt to the player are an initially dealt hand for the player in baccarat.

13. The method of claim 8, wherein the payout to the player varies at least partially as a function of a number of cards from the set of four cards drawn that have equal rank, wherein the payout increases in response to the number of cards having equal rank increasing.

14. The method of claim 13 further comprises identifying, by the at least one card sensor, a suit symbol of each drawn card and generating suit symbol data, and wherein a progressive jackpot is awarded to the player at least partially in response to the suit symbol data of the set of four drawn cards indicating the set of four drawn cards have a matching suit symbol.

15. A game controller for administering a baccarat secondary bet, the game controller positioned at a gaming table with multiple player positions and a layout positioned on an upper surface of the gaming table, the layout marked with indicia to indicate the multiple player positions and a unique identifier for each player position, the game controller communicatively coupled to a shoe containing a shuffled set of cards, wherein each unique identifier matches a rank of at least one subset of cards in the set of cards, the game controller comprising:

a communication device communicatively coupled to at least one card sensor of the shoe, the at least one card sensor configured to identify a rank of each drawn card and generate rank data indicating the identified rank of each drawn card;

at least one processor; and a memory device configured to store computer-executable instructions that, when executed by the at least one processor, cause the game controller to be configured to:

receive the rank data for a set of four cards drawn in a game of baccarat from the shoe; and in response to determining that at least two of the four drawn cards have an equal rank that is equal to the unique identifier of one of the player positions and that a secondary wager has been registered for that unique identifier, provide a visual indication of a payout to a player at the one of the player positions.

16. The game controller of claim 15, wherein the game controller is communicatively coupled to at least one bet sensor, the at least one bet sensor configured to detect at least the presence of the secondary wager at the one of the player positions and generate wager sensor data associated with the unique identifier of the one of the player positions.

17. The game controller of claim 15, wherein the set of four cards drawn in the game of baccarat includes two cards dealt to a dealer and two cards dealt to a player at one of the multiple player positions of the gaming table.

18. The game controller of claim 17, wherein the two cards dealt to the player are an initially dealt hand for the player in baccarat.

19. The game controller of claim 15, wherein the payout to the player varies at least partially as a function of a number of cards from the set of four cards drawn that have equal rank, wherein the payout increases in response to the number of cards having equal rank increasing.

20. The game controller of claim 19, wherein the at least one card sensor is configured to identify a suit symbol of each drawn card and generate suit symbol data, and wherein a progressive jackpot is awarded to the player at least partially in response to the suit symbol data of the set of four drawn cards indicating the set of four drawn cards have a matching suit symbol.

* * * * *